US007633407B2

(12) United States Patent
Yano et al.

(10) Patent No.: US 7,633,407 B2
(45) Date of Patent: Dec. 15, 2009

(54) VEHICLE COMMUNICATION DEVICE AND MEMORY PRODUCT

(75) Inventors: Katsutoshi Yano, Kawasaki (JP); Jun Kawai, Kawasaki (JP); Hiroshi Yamada, Kawasaki (JP)

(73) Assignee: Fujitsu Limited, Kawasaki (JP)

( * ) Notice: Subject to any disclaimer, the term of this patent is extended or adjusted under 35 U.S.C. 154(b) by 296 days.

(21) Appl. No.: 11/902,844

(22) Filed: Sep. 26, 2007

(65) Prior Publication Data

US 2008/0158009 A1 Jul. 3, 2008

(30) Foreign Application Priority Data

Dec. 27, 2006 (JP) ..... 2006-353201

(51) Int. Cl.
*G08G 1/16* (2006.01)

(52) U.S. Cl. ..... 340/903; 340/937; 340/904; 340/463; 340/475

(58) Field of Classification Search ..... 340/903, 340/904, 937, 463, 475
See application file for complete search history.

(56) References Cited

U.S. PATENT DOCUMENTS 6,169,940 B1 * 1/2001 Jitsukata et al. ..... 701/23
6,249,232 B1 * 6/2001 Tamura et al. ..... 340/902
6,885,968 B2 * 4/2005 Breed et al. ..... 702/143
6,985,089 B2 * 1/2006 Liu et al. ..... 340/903
7,181,343 B2 * 2/2007 Mukaiyama ..... 701/200
7,202,776 B2 * 4/2007 Breed ..... 340/435
7,209,221 B2 * 4/2007 Breed et al. ..... 356/5.02
7,304,589 B2 * 12/2007 Kagawa ..... 340/995.13
7,443,314 B2 * 10/2008 Konishi et al. ..... 340/903
2004/0061600 A1 * 4/2004 Wehner et al. ..... 340/435
2007/0013497 A1 * 1/2007 Watanabe ..... 340/435
2008/0042876 A1 * 2/2008 Bauer et al. ..... 340/905

FOREIGN PATENT DOCUMENTS

JP 9-98125 20 4/1997
JP 2005-215753 8/2005

* cited by examiner

*Primary Examiner*—Eric M Blount
(74) *Attorney, Agent, or Firm*—Kratz, Quintos & Hanson, LLP

(57) ABSTRACT

There is provided a vehicle communication device and a computer program that can avoid a dangerous situation generated when a driver performs an operation such as selection of a vehicle to which notification information is to be sent when communication is made between vehicles and improve safety. A plurality of imaging devices are arranged around a vehicle. The vehicle communication device detects the circumstance of its own vehicle, and refers to a predetermined table based on the detected circumstance, to determine the notification information to be sent and the direction to confirm the existence of other vehicles, and transmits the notification information to the other vehicles detected by the imaging device for detecting the vehicle in the detected direction.

10 Claims, 23 Drawing Sheets

FIG. 3

| OPERATION INFORMATION |
| --- |
| INDICATOR OPERATION [2bit] |
| HEADLAMP OPERATION [1bit] |
| CRUISING INFORMATION |
| CRUISING SPEED [16bit] |
| INTERVEHICLE DISTANCE [32bit] |
| ROAD INFORMATION |
| ROAD SECTION [2bit] |
| CRUISING POSITION [2bit] |
| LANE POSITION [3bit] |

FIG. 4

| ROAD INFO. | OTHERS | EXPWY | | | STREET | | | | | | | | | | |
|---|---|---|---|---|---|---|---|---|---|---|---|---|---|---|---|
| | | | | | CROSS-ING | | | | IN FRONT OF CRSG. | | | OTHERS | | |
| | | L. LANE | C. LANE | R. LANE | R. TURN | L. LANE | C. LANE | R. LANE | L. LANE | C. LANE | R. LANE | L. LANE | C. LANE | R. LANE |
| 1ST CIRC. VAR. | 0 | 1 | 2 | 3 | 4 | 5 | 6 | 7 | 8 | 9 | 10 | 11 | 12 | 13 |

| OP. INFO. | CRUISE INFO. | 2ND CIRC. VAR. | | | | | | | | | | | | | | | |
|---|---|---|---|---|---|---|---|---|---|---|---|---|---|---|---|---|---|
| INDICATOR (ON·R) | SPE. ≦ 5km/h | 0 | | 0 | 1 | 1 | 0 | 3 | 1 | 1 | 3 | 1 | 1 | 6 | 1 | 1 | 0 |
| | SPE. ≧ 40km/h | 1 | | 0 | 1 | 1 | 5 | 0 | 1 | 1 | 0 | 1 | 1 | 6 | 1 | 1 | 0 |
| INDICATOR (ON·L) | SPE. ≦ 5km/h | 2 | | 0 | 0 | 2 | 2 | 2 | 4 | 2 | 2 | 7 | 2 | 2 | 0 | 2 | 2 |
| | SPE. ≧ 40km/h | 3 | | 0 | 0 | 2 | 2 | 0 | 0 | 2 | 2 | 7 | 2 | 2 | 0 | 2 | 2 |
| HEADLAMP FLASH | DST. < 3m AND SPE. ≦ 40km/h | 4 | | 0 | 0 | 0 | 5 | 0 | 0 | 0 | 0 | 0 | 0 | 0 | 0 | 0 | 5 |
| | SPE. ≦ 5km/h | 5 | | 0 | 8 | 0 | 9 | 0 | 0 | 0 | 8 | 8 | 0 | 9 | 8 | 0 | 9 |

FIG. 5

| | CAMERA ID INFORMATION | SCOPE |
|---|---|---|
| 1:LANE CHANGE·RIGHT | 5 | 2 |
| 2:LANE CHANGE·LEFT | 6 | 1 |
| 3:CROSSING·RIGHT TURN | 4 | 4 |
| 4:CROSSING·LEFT TURN | 2 | 2 |
| | 6 | 1 |
| 5:LANE HAND OVER 1 | 1 | 2 |
| 6:PREPARATION OF RIGHT TURN | 2 | 2 |
| | 5 | 2 |
| 7:PREPARATION OF LEFT TURN | 2 | 2 |
| | 6 | 1 |
| 8:LANE HAND OVER 2 | 3 | 1 |
| 9:LANE HAND OVER 3 | 4 | 3 |

4 : ALL OVER

FIG. 7

| | MESSAGE |
|---|---|
| 1:LANE CHANGE·RIGHT | GOING TO CHANGE LANES TO RIGHT, WATCH. |
| 2:LANE CHANGE·LEFT | GOING TO CHANGE LANES TO LEFT, WATCH. |
| 3:CROSSING·RIGHT TURN | GOING TO TURN TO RIGHT AT CROSSING AHEAD. |
| 4:CROSSING·LEFT TURN | GOING TO TURN TO LEFT AT CROSSING AHEAD. |
| 5:LANE HAND OVER 1 | IN A HURRY! HAVE ME PASS PLEASE! |
| 6:PREPARING OF RIGHT TURN | GOING TO TURN RIGHT SOON, CAREFUL. |
| 7:PREPARING OF LEFT TURN | GOING TO TURN LEFT SOON, CAREFUL. |
| 8:LANE HAND OVER 2 | AFTER YOU:-) |
| 9:LANE HAND OVER 3 | AFTER YOU:-) |

FIG. 8A

FIG. 8B

FIG. 8C

VCL. COMM. APP. 10

VEHICLE COMMUNICATION DEVICE AND MEMORY PRODUCT

CROSS-REFERENCE OF RELATED APPLICATION

This non-provisional application claims priority under 35 U.S.C. §119(a) on Patent Application No. 2006-353201 in Japan on Dec. 27, 2006, the entire contents of which are hereby incorporated by reference.

BACKGROUND

1. Technical Field

The present invention relates to an on-board vehicle communication device for communicating with other vehicles and a memory product recording a computer program for implementing the vehicle communication device and more particularly, to a vehicle communication device and a memory product recording a computer program capable of implementing the communication between vehicles without losing safety.

2. Description of Related Art

Currently, a communication method for implementing safe and smooth travel through exchange of information by transmitting and receiving information such as a message, as notification information, from a driver among a plurality of vehicles has been studied (for example, Japanese Patent Application Laid-Open No. H09-098125).

FIG. 22 is a view conceptually showing one example of a communication method among vehicles. Reference numeral 1000 in FIG. 22 designates a first vehicle and four second vehicles 2000, 2000, . . . run around the first traveling (cruising) vehicle 1000. In the circumstance shown in FIG. 22, a monitor mounted on the first vehicle 1000 displays the peripheral second vehicles 2000, 2000, . . . , and when the first vehicle 1000 is to change its lane to a right lane in the circumstance shown in FIG. 22, the driver of the first vehicle 1000 selects the second vehicle 2000 (upper right in the drawing) cruising in back on the right of the first vehicle 1000 as the message destination and sends the message such as "I will change the lane to the right, so please be careful" to that vehicle. When the second vehicle 2000 receives the message and outputs it by means of characters, an image or sound, the driver of the second vehicle 2000 can recognize the movement of the first vehicle 1000, so that a smooth travel can be implemented.

SUMMARY

According to the conventional communication method among the vehicles, when the driver selects the vehicle to which the message is to be sent or inputs the message to be sent, the driver has to view the monitor and uses one hand for the operation. As a result, the driver can be preoccupied by the operation.

In addition, when voice recognition is used in selecting the vehicle and inputting the message, an environmental noise such as a cruising noise in the traffic can prevail driver voices.

An object is to provide a vehicle communication device that does not need the operation by a driver and improves safety for driving, and to provide a computer program for implementing such vehicle communication device.

There is provided a vehicle communication device according to an aspect, to be mounted on one vehicle provided with a plurality of vehicle detection devices for detecting other vehicles, comprising:

a communication device for transmitting information to the detected other vehicles and receiving information from the other vehicles;

an output device for outputting the received information; and a control unit for performing the operations of:

obtaining pieces of information containing information regarding a driving operation, based on a table previously relating circumstances of the one vehicle to the obtained pieces of information, detecting the circumstance of the one vehicle corresponding to the obtained piece of information, based on a table previously relating the respective vehicle detection devices each of which faces in a direction to recognize presence or absence of the other vehicles, to the detected circumstances of the one vehicle, determining the vehicle detection device corresponding to the detected circumstance, based on vehicle detection information obtained in accordance with detection by the determined vehicle detection device, detecting vehicle identification information of the other vehicle to/from which the information is transmitted/received by the communication device, and based on a table previously relating pieces of notification information to be notified to the other vehicle, to the detected circumstances of the one vehicle, determining the piece of notification information to be notified to the other vehicle, the piece of notification information being corresponding to the detected circumstance, wherein the communication device transmits the determined piece of notification information to the other vehicle, regarding the detected vehicle identification information as a communication identifier of the other destination vehicle.

There is provided a vehicle communication device according to an aspect, wherein the pieces of information comprising the information regarding the driving operation further comprises information regarding a traveling condition and information regarding a traveling road.

There is provided a vehicle communication device according to an aspect, wherein the plurality of vehicle detection devices are a plurality of imaging devices arranged to take images around the one vehicle, and the control unit detects a vehicle number on a number plate of the other vehicle as the vehicle identification information, based on the image taken by the determined vehicle detection device, in the operation for detecting the vehicle identification information of the other vehicle.

There is provided a vehicle communication device according to an aspect, wherein the information regarding the driving operation comprises information regarding at least one of a direction indicator and a headlamp.

There is provided a vehicle communication device according to an aspect, wherein the information regarding the traveling condition comprises information regarding at least one of a traveling speed and a distance to a vehicle in back.

There is provided a vehicle communication device according to an aspect, wherein the information regarding the road comprises information regarding at least a traffic lane position, a road segment and a positional relation to another road.

There is provided a vehicle communication device according to an aspect, wherein the notification information comprises message data to notify the other vehicle of the circumstance of the one vehicle.

There is provided a vehicle communication device according to an aspect, wherein the notification information further comprises at least a piece of data of the vehicle identification information of the other vehicle, a piece of data of the vehicle identification information of the one vehicle, and pieces of data regarding the position, speed, direction indicator state of the vehicle.

There is provided a computer-readable memory product according to an aspect, which records a computer-executable computer program for causing a computer to generate notification information, the computer being to be mounted on one vehicle provided with a plurality of vehicle detection devices for detecting other vehicles and the notification information being transmitted to the other vehicles, the computer program comprising:

causing the computer to obtain pieces of information containing information regarding a driving operation;

based on a table previously relating circumstances of the one vehicle to the obtained pieces of the information, causing the computer to detect the circumstance of the one vehicle corresponding to the obtained piece of the information;

based on a table previously relating the respective vehicle detection devices each of which faces in a direction to recognize presence or absence of the other vehicles, to the detected circumstances of the one vehicle, causing the computer to determine the vehicle detection device corresponding to the detected circumstance;

based on vehicle detection information obtained in accordance with detection by the determined vehicle detection device, causing the computer to detect vehicle identification information of the other vehicle to which the notification information is transmitted; and based on a table previously relating pieces of the notification information to be transmitted to the other vehicle, to the detected circumstances of the vehicle, causing the computer to determine the piece of the notification information to be transmitted to the other vehicle, the piece of the notification information being in accordance with the detected circumstance.

There is a vehicle communication device according to an aspect, to be mounted on one vehicle provided with a plurality of vehicle detection devices for detecting other vehicles, comprising:

a communication part for transmitting information to the detected other vehicles and receiving information from the other vehicles;

an output part for outputting the received information;

an information obtaining part for obtaining pieces of information containing information regarding a driving operation;

a vehicle circumstance detecting part, based on a table previously relating circumstances of the one vehicle to the obtained pieces of the information, for detecting the circumstance of the one vehicle corresponding to the obtained piece of the information;

a vehicle detecting device determining part, based on a table previously relating the respective vehicle detection devices each of which faces in a direction to recognize presence or absence of the other vehicles, to the detected circumstances of the one vehicle, for determining the vehicle detection device corresponding to the detected circumstance;

a vehicle identification information detecting part, based on vehicle detection information obtained in accordance with detection by the determined vehicle detection device, for detecting vehicle identification information of the other vehicle to/from which the information is transmitted/received by the communication device; and a notification information determining part, based on a table previously relating pieces of notification information to be notified to the other vehicle, to the detected circumstances of the one vehicle, for determining the piece of the notification information to be notified to the other vehicle, the piece of the notification information being in accordance with the detected circumstance, wherein the communication part transmits the determined piece of the notification information to the other vehicle, regarding the detected vehicle identification information as a communication identifier of the other destination vehicle.

BRIEF DESCRIPTION OF THE DRAWINGS

FIG. 3 is a table conceptually showing one example of recorded contents in a detection information table provided in the vehicle communication device according to an embodiment;

FIG. 4 is a table conceptually showing one example of recorded contents in a circumstance determination table provided in the vehicle communication device according to an embodiment;

FIG. 5 is a table conceptually showing one example of recorded contents in a direction determination table provided in the vehicle communication device according to an embodiment;

FIG. 7 is a table conceptually showing one example of recorded contents in a notification information determination table provided in the vehicle communication device according to an embodiment;

FIGS. 8A, 8B and 8C are tables conceptually showing one example of a packet format of circumstance information used in the vehicle communication device according to an embodiment;

DETAILED DESCRIPTION

Figure 1:
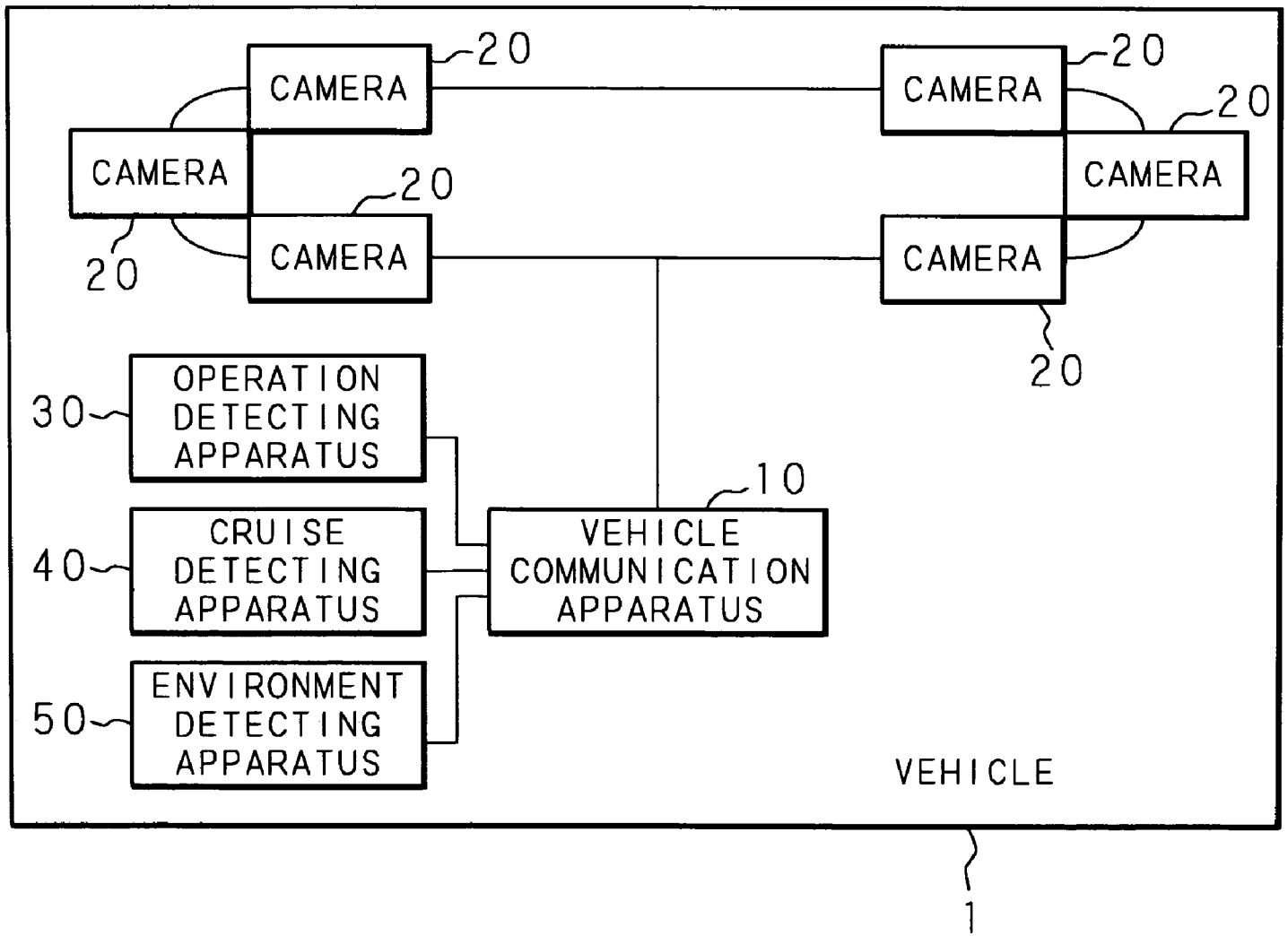
FIG. 1 is a block diagram showing the constitution example of a vehicle system using a vehicle communication device according to an embodiment.
Figure 2:
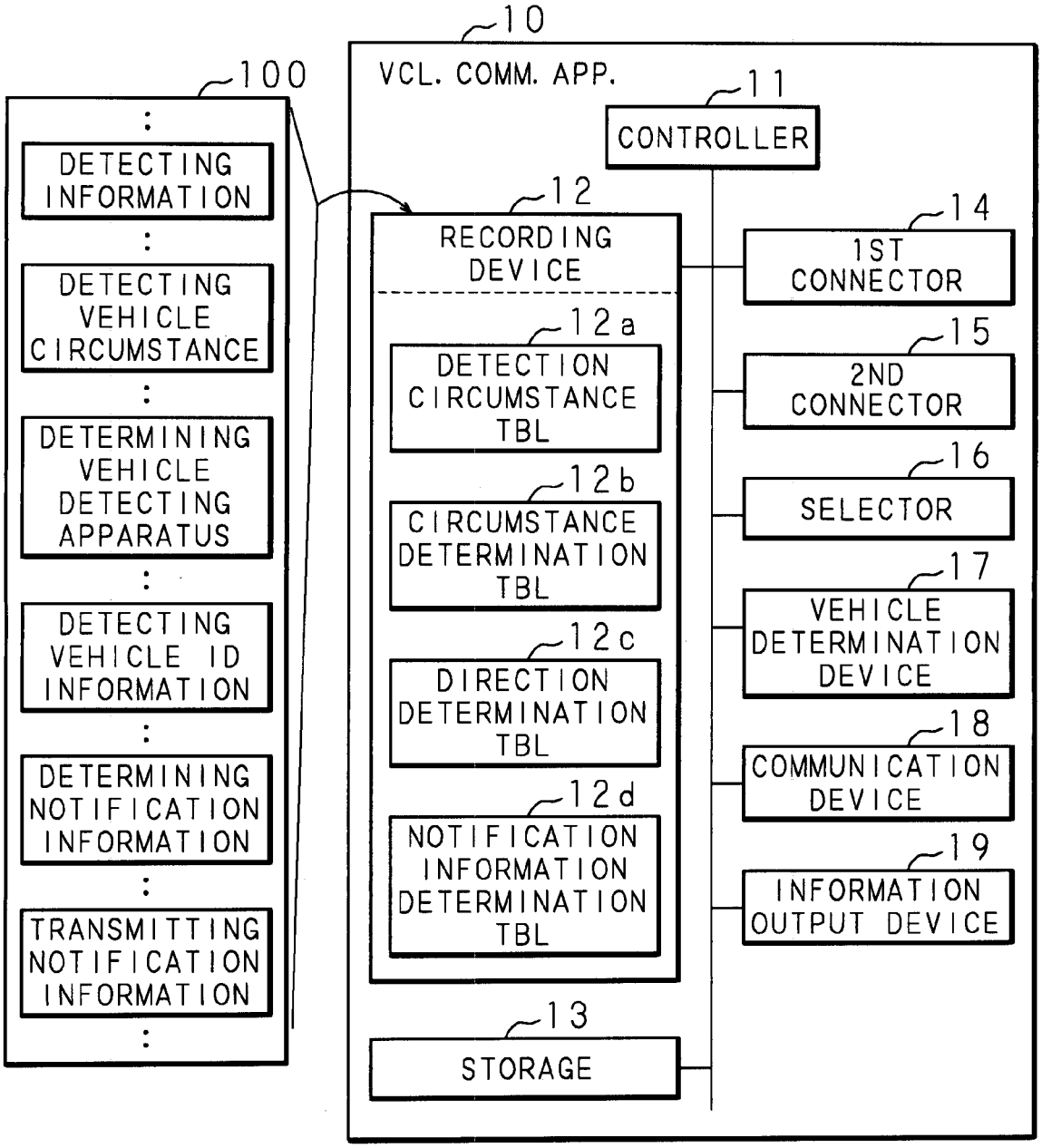
FIG. 2 is a block diagram showing the constitution example of the vehicle communication device according to an embodiment.

FIG. 1 is a block diagram showing the constitution of a vehicle system using a vehicle communication device according to an embodiment, and FIG. 2 is a block diagram showing the constitution of the vehicle communication device according to an embodiment. Reference numeral 1 in FIG. 1 designates a vehicle and the vehicle 1 has a vehicle communication system comprising a vehicle communication device 10 using an in-vehicle (on-board) computer, a plurality of imaging devices 20, 20, . . . (vehicle detection device) such as CCD cameras arranged around the vehicle 1 to shoot another surrounding vehicle, an operation detection device 30 for detecting information regarding the operation of a driver who drives the vehicle 1, a cruising (traveling) detection device 40 for detecting information regarding the cruising (traveling) condition of the vehicle 1, and an environment detection device 50 for detecting information regarding the environment of a road on which the vehicle cruises (travels). In addition, the above devices are connected through a communication medium such as an in-vehicle communication network and various kinds of communication lines based on the specification such as CAN so as to be able to communicate with each other.

Next, the constitution of the vehicle communication device according to an embodiment will be described. As shown in FIG. 2, the vehicle communication device 10 comprises controlling means (controller) 11 such as a CPU for controlling the device, recording means (recording device) 12 such as a ROM and a hard disk in which a computer program 100 for the vehicle communication device is stored, and storing means (storage) 13 such as a RAM, and when the computer program 100 recorded in the recording means 12 is stored in the storing means 13 and executed by the controlling means 11, the in-vehicle computer operates as the vehicle communication device 10. In addition, a part of a recording area of the recording means 12 is used as various kinds of tables such as a detection information table (detection information TBL) 12*a* for recording the information detected by the operation detection device 30, the cruising detection device 40 and the environment detection device 50, a circumstance determination table (circumstance determination TBL) 12*b* for determining the circumstance of its own vehicle based on the detected information, a direction determination table (direction determination TBL) 12*c* for determining the direction to confirm the existence of another vehicle based on the detected circumstance of the vehicle, and a notification information determination table (notification information determination TBL) 12*d* for determining notification information based on the circumstance of the vehicle.

Furthermore, the vehicle communication device 10 comprises first connecting means 14 as an interface connected to the operation detection device 30, the cruising detection device 40 and the environment detection device 50, second connecting means 15 as an interface connected to the imaging devices 20, 20, . . . , selecting means 16 for selecting video information to be analyzed in the video information that the second connecting means 15 received from the imaging device 20,20, . . . , vehicle determining means 17 for determining another vehicle to be noticed with the notification information by analyzing the video information selected by the selecting means 16, communicating means (communication device) 18 for communicating with the other vehicle, and information outputting means (output device) 19 such as a speaker or monitor for noticing the driver with the received information.

Referring to FIG. 1 again, the imaging devices (vehicle detection devices) 20, 20 . . . are provided at a position for shooting the front of the vehicle 1, a position for shooting the back, a position for shooting the front on the right, a position for shooting the front on the left, a position for shooting the back on the right and a position for shooting the back on the left. The video images taken by the imaging devices 20, 20, . . . are sent to the vehicle communication device 10 as video information. Imaging device identification information is allocated to each of the imaging devices 20, 20, . . . and the imaging device identification information is attached to the video information transmitted from each of the imaging devices 20, 20, . . . as information showing a transmission source.

The operation detection device 30 detects, at specified time intervals, the circumstance of the operation of the mechanism such as various kinds of switches, various kinds of lever, a steering wheel, an accelerator, and gear provided in the vehicle 1 and operated by the driver, and transmits operation information showing the detected circumstance to the vehicle communication device 10. The operation information to be transmitted includes information showing the circumstances regarding driving operations such as a direction indicator (winker) operation, flashing operation, a handle operation, an accelerator operation, a gear shift operation, a hazard flasher operation and the like. Although FIG. 1 shows only one operation detection device 30 for convenience, a plurality of operation detection devices 30, 30, . . . may be used. In addition, as a method for detecting the circumstance, the movement of a lever for operating a headlight may be detected, or the energized state of the headlight may be detected, for example.

The cruising detection device 40 detects, at specified time intervals, a cruising (traveling) condition such as the cruising (traveling) speed of the vehicle 1 and the distance to the vehicle in back based on a measuring meter such as a speed meter, and a distance detecting meter provided in the rear part of the vehicle 1 to detect the distance to the vehicle in back using an electromagnetic wave, and transmits cruising information showing the detected circumstance to the vehicle communication device 10. Although FIG. 1 shows only one cruising detection device 40 for convenience, a plurality of cruising detection devices 40, 40, . . . may be used.

The environment detection device 50 detects, at specified time intervals, a circumstance such as a traffic lane position, a road segment, a positional relation to a sidewalk, and a positional relation to another vehicle road, where the vehicle 1 is cruising (traveling), based on the GPS-based present position and map information, and transmits road information showing the detected circumstance to the vehicle communication device 10. The traffic lane position is information regarding the traffic lane such as a driving lane, a passing lane, a right turn lane, a center lane, a right lane and a left lane. The road segment is information regarding a road segment such as an express way and a general road. The positional relation to the sidewalk is information regarding the positional relation to the sidewalk such as the position on a pedestrian crossing, in front of a pedestrian crossing, and parallel to the general road. The positional relation to another vehicle road is information regarding the positional relation to another vehicle road such as the position at an intersection crossing a road different from the road of the vehicle 1, that is, another vehicle road, in front of the intersection, at a junction with another road, and in front of a junction.

Next, the process of the vehicle communication device 10 will be described. The vehicle communication device 10 uses the detection circumstance table 12*a*, the circumstance determination table 12*b*, the direction determination table 12*c* and the notification information determination table 12*d* in the process.

FIG. 3 is a table conceptually showing one example of the recorded contents of the detection circumstance table 12*a* provided in the vehicle communication device 10. The detection circumstance table 12*a* contains the information about the operation of the mechanism detected by the operation detection device 30, the information about the cruising (traveling) condition detected by the cruising (traveling) detection device 40 and the information about the circumstance such as the road environment detected by the environment detection device 50.

As examples of the information of the operation of the operating mechanism, the information of the direction indicator operation and the information of the headlamp operation are shown in FIG. 3. The information of the direction indicator operation is shown by 2-bit data of bit0 and bit1. When the bit0 is "0", it means the operation of the left indicator and when the bit0 is "1", it means the operation of the right indicator. When the bit1 is "0", it means an off operation and when the bit1 is "1", it means an on operation. In addition, the initial values of the bit0 and bit1 are "0". The information of the headlamp operation is shown by 1-bit data of bit0. When bit0 is "1", it means that the operation has been performed, and when bit0 is "0", it means that the operation has not been performed. In addition, the initial value of the bit0 is "0".

As examples of the information regarding the cruising (traveling) condition, information about the cruising (traveling) speed and the distance to the vehicle in back are shown in FIG. 3. According to the information of the cruising (traveling) speed, a numeric value by the "km/h" is shown by 16-bit data. In addition, the initial value of each bit is "0". According to the information of the distance between the vehicles, the numeric value in the "cm" is shown by 32-bit data. The initial value of each bit is "0".

As examples of the information regarding the road environment, the circumstances of the road segment and the positional relation with another vehicle road (cruising position) and the traffic lane position are shown in FIG. 3. The information of the road section is shown by 2-bit data, in which the general road is shown as "01" and the express way is shown as "10" and the road other than the general road and the expressway is shown as "00". In addition, its initial value is "00". The information about the cruising (traveling) position is shown by 2-bit data, in which the case at the intersection is shown as "01", the case within 30 m to the intersection is shown as "10", and the case other than at the intersection and within 30 m to the intersection is shown as "11". In addition, its initial value is "00". The information of the traffic lane is shown by 3-bit data, in which the right lane is shown as "001", the center lane is shown as "010, the left lane is shown as "011", and the right turn lane is shown as "100". In addition, its initial value is "000".

FIG. 4 is a table conceptually showing one example of recorded contents of the circumstance determination table 12*b* provided in the vehicle communication device 10. The circumstance determination table 12*b* is the table for determining the circumstance of the vehicle itself based on the information detected by the operation detection device 30, the cruising detection device 40 and the environment detection device 50, and according to the example shown in FIG. 4, the circumstance of the vehicle is derived as the number from the relation between the information regarding the driving operation, the information regarding the cruising condition and the information regarding the cruising road.

As the number showing the circumstance of the vehicle, "0" designates "no notice needed", "1" designates "lane change, right", "2" designates "lane change, left", "3" designates "intersection, right turn", "4" designates "intersection, left turn", "5" designates "lane transfer 1", "6" designates "right turn preparation", "7" designates "left turn preparation", "8" designates "lane transfer 2", and "9" designates "lane transfer 3".

For example, when the direction indicator on the right is operated and the speed of the vehicle 1 is not more than 5 km/h and the vehicle 1 is in the right turn lane in the intersection in the general road, the number designating the circumstance of the vehicle 1 is "3". Since the number "3" is related to the circumstance designating "intersection, right turn", as the notification information sent to another vehicle, the notification information showing "intersection, right turn", the message "this vehicle will turn right at this intersection", for example, is transmitted.

In addition, a first circumstance variable (x) is allocated to each item showing the information regarding the cruising road. For example, the first circumstance variable (x) in the left lane in the express way is "1", and the first circumstance variable (x) in the center lane at the intersection is "6". Furthermore, a second circumstance variable (y) is allocated to the combination of the information regarding the driving operation and the information regarding the cruising condition. For example, the second circumstance variable (y) of the combination of the direction indicator operation in which the indicator on the left side is turned on and the cruising speed of 5 km/h or less is "2". Thus, the allocated first circumstance variable (x) and the second circumstance variable (y) are used as variables when the number designating the circumstance of the vehicle 1 in the circumstance determination table 12*b* is derived from the combination of the circumstances. In addition, the notification information about the circumstance of the vehicle 1 is determined based on the number designating the circumstance of the vehicle 1.

Figure 6A:
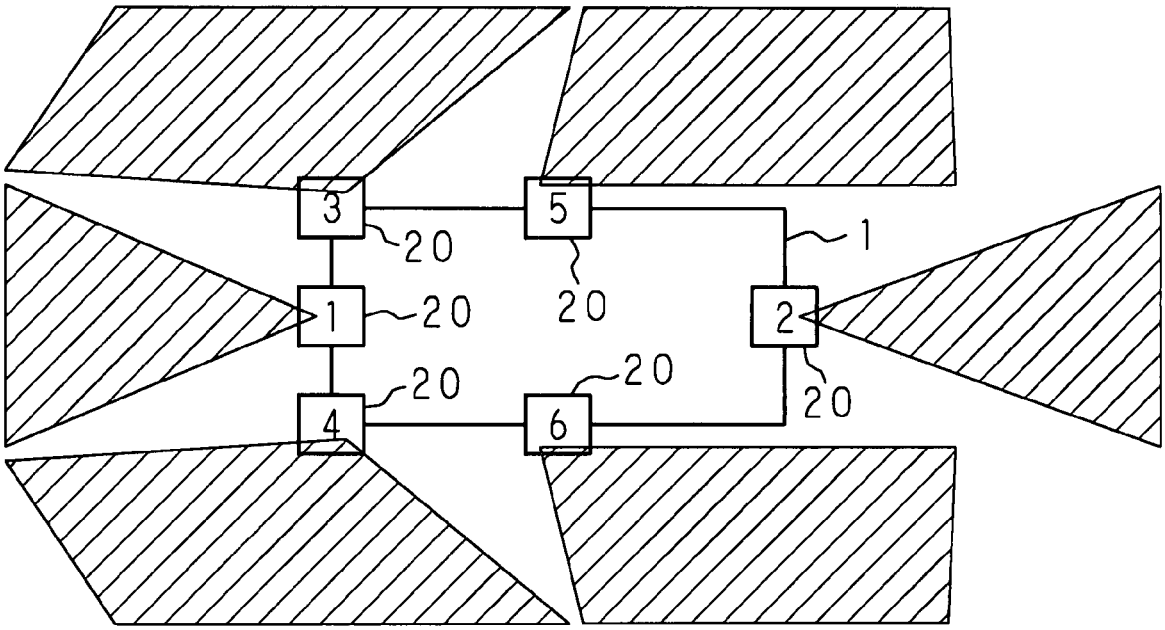
FIGS. 6A and 6B are views showing one example of directions shown in the direction determination table provided in the vehicle communication device according to an embodiment.
Figure 6B:
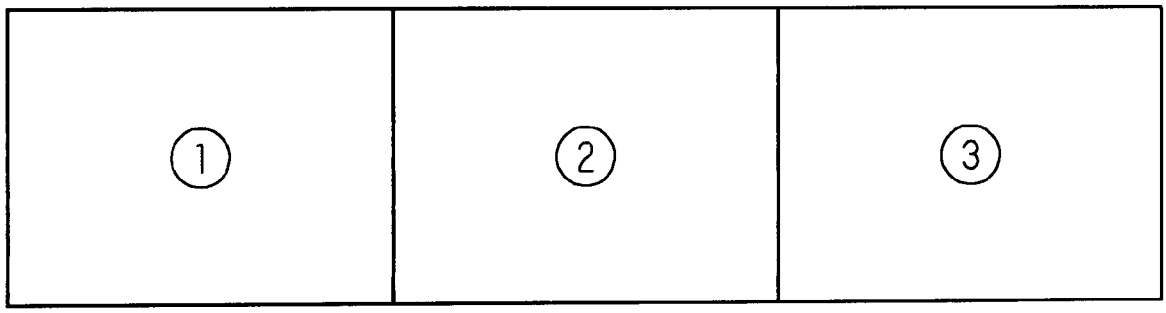

FIG. 5 is a table conceptually showing one example of recorded contents in the direction determination table 12*c* provided in the vehicle communication device 10. FIGS. 6A and 6B are views showing one example of the directions shown in the direction determination able 12*c* provided in the vehicle communication device 10. The direction determination table 12*c* shown in FIG. 5 shows imaging device identification information and the effective shooting range of the imaging device 20 identified by imaging device identification information so as to be related to the number designating the circumstance of the vehicle 1, that is derived using the circumstance determination table 12*b* from the relation of the information regarding the driving operation and the information regarding the cruising and the information regarding the cruising road. In addition, FIG. 6A shows the shooting range of each of the imaging devices 20, 20, . . . arranged around the vehicle 1. The imaging device 20 to which "1" in a box is allotted is arranged at a position to shoot the front of the vehicle 1, the imaging device 20 to which "2" is allotted is arranged at a position to shoot the back, the imaging device 20 to which "3" is allotted is arranged at a position to shoot the front on the right, the imaging device 20 to which "4" is allotted is arranged at a position to shoot the front on the left, the imaging device 20 to which "5" is allotted is arranged at a position to shoot the back on the right, and the imaging device 20 to which "6" is allotted is arranged at a position to shoot the back on the left. FIG. 6B shows the effective range in the shooting range of the imaging device 20, and the circled number corresponds to the shooting range shown in the direction determination table 12*c* in FIG. 5. For example, in the case of the "lane change, right" in which the number designating the circumstance of the vehicle 1 is "1", the imaging device identification information is "5" and the number designating the effective range is "2". Therefore, in the shooting range of the imaging device 20 arranged at the back on the right of the vehicle 1, the center is the effective range and another vehicle shown in the center is determined as the vehicle to which the notification information is sent. In addition, in the case of the "intersection, left turn" in which the number designating the circumstance of the vehicle 1 is "4", the imaging device identification information "2" and the effective range "2" are related and the imaging device identification information "5" and the effective range "2" are related. Thus, in this case, other vehicles positioned in the plurality of areas are determined as the destinations of the notification information.

FIG. 7 is a table conceptually showing one example of the recorded contents of the notification information determination table 12*d* provided in the vehicle communication device 10. The notification information determination table 12*d* in FIG. 7 shows notice messages to be sent to the other vehicle so as to relate them to the number designating the circumstance of the vehicle 1 derived using the circumstance determination table 12*b* from the relation of the information regarding the driving operation, the information regarding the cruising condition and the information regarding the cruising road. For example, in the case of the "intersection, right turn" in which the number designating the circumstance of the vehicle 1 is "3", the message to be sent to the other vehicle is "this vehicle will turn right at this intersection".

Next, a description will be made of the processes of the various devices provided in the vehicle communication system in an embodiment. Each of the operation detection device 30, the cruising detection device 40 and the environment detection device 50 transmits the circumstance information designating the detected circumstance to the vehicle communication device 10.

FIGS. 8A to 8C are views conceptually showing one example of a packet format of the circumstance information used in the vehicle communication device. FIG. 8A shows a packet format of the circumstance information, and one-byte attribute identifier storage field, one-byte information identifier storage field, one-byte data length storage field, and a variable data field are provided in the packet used for transmitting and receiving the circumstance information as shown in FIG. 8A.

The data showing the attribute of the circumstance information corresponding to the device of the transmission source is stored in the attribute identifier storage field. Thus, "0x01" is stored in the circumstance information regarding the mechanism of the operation transmitted from the operation detection device 30 as the attribute, "0x02" is stored in the circumstance information regarding the cruising condition transmitted from the cruising detection device 40 as the attribute, and "0x03" is stored in the circumstance information regarding the road environment transmitted from the environment detection device 50 as the attribute.

The data showing the kind of the circumstance information is stored in the information identifier storage field and "0x01" is stored for the circumstance information regarding the direction indicator operation, and "0x02" is stored for the circumstance information regarding the headlamp operation. In addition, "0x03" is stored for the circumstance information regarding the cruising speed, "0x04" is stored for the circumstance information regarding the distance between the vehicles, "0x05" is stored for the circumstance information regarding the road segment, "0x06" is stored for the circumstance information regarding the positional relation with another road, and "0x07" is stored for the circumstance information regarding the traffic lane position.

The data showing the data length of the data stored in the variable data field is stored in the data length storage field. In the data field, the data itself described with reference to FIG. 3 is stored.

FIGS. 8B and 8C show specific example of the circumstance information transmitted and received in the packet format shown in FIG. 8A. According to FIG. 8B, since the attribute identifier storage field is "0x01", the information identifier storage field is "0x01", the data length storage field is "0x02", and the data field is "10", the circumstance information shows that the right indicator is turned on as the direction indicator operation transmitted from the operation detection device 30. According to FIG. 8C, since the attribute identifier storage field is "0x02", the information identifier storage field is "0x03", the data length storage field is "0x10", and the data field is "0000000001111000", the circumstance information shows 120 km/h as the cruising speed transmitted from the cruising detection device 40.

The vehicle communication device 10 executes various kinds of operations using the circumstances detected by the operation detection device 30, the cruising detection device 40, the environment detection device 50 in the vehicle 1 as triggers. First, the vehicle communication device 10 detects the circumstance of its own vehicle from the information showing the various circumstances detected by the operation detection device 30, the cruising detection device 40 and the environment detection device 50 based on the circumstance determination table 12*b*. Then, the vehicle communication device 10 determines the imaging device 20 to turn to the direction to confirm the existence of another vehicle from the detected circumstance of its own vehicle based on the direction determination table 12*c*. A description will be made of a specific process example to detect the circumstance of its own vehicle based on the circumstance determination table 12*b* and to determine the imaging device 20 based on the direction determination table 12*c*.

Figure 9:
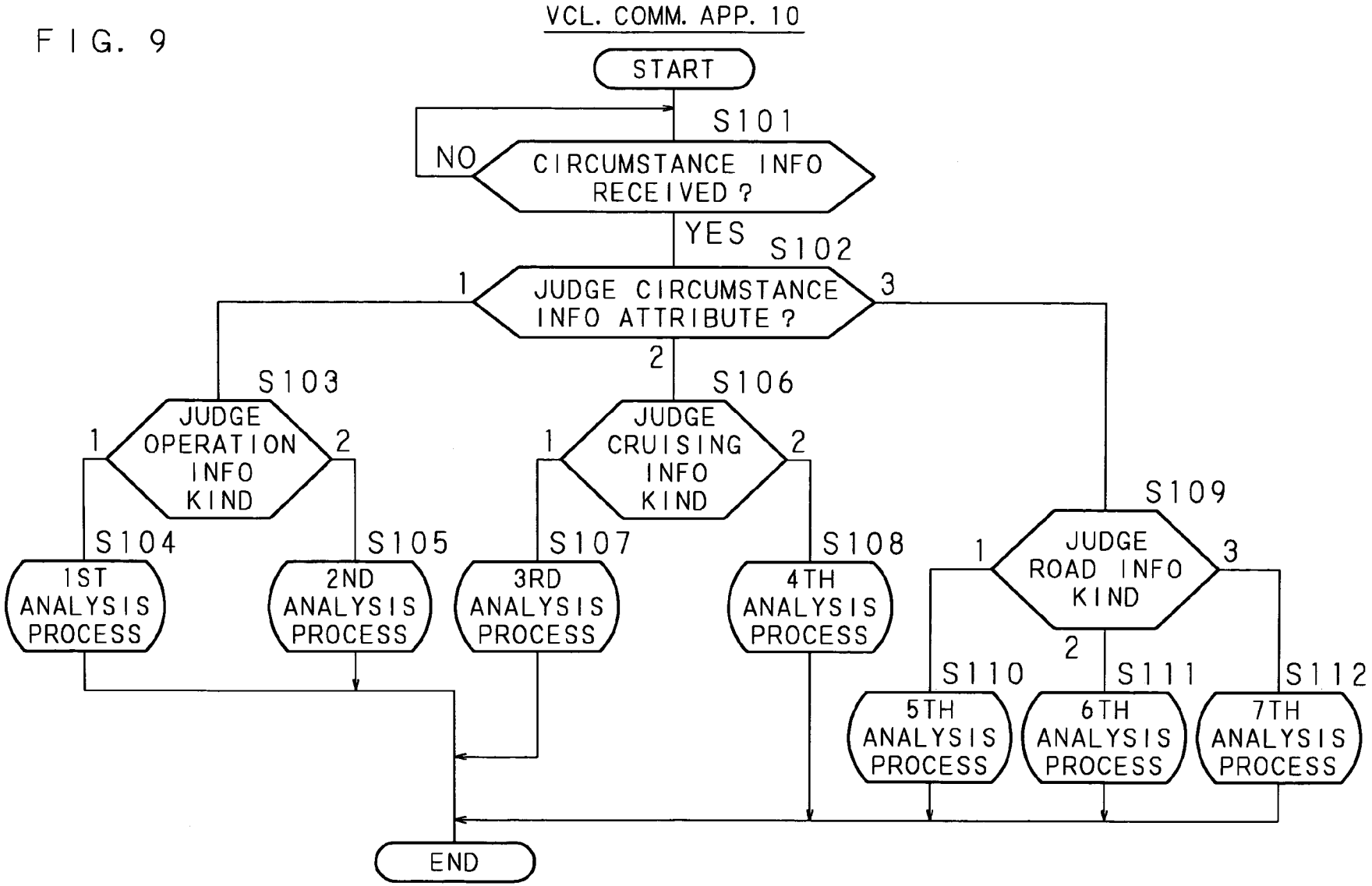
FIG. 9 is a flowchart showing one example of attribute and kind determination process of the vehicle communication device according to an embodiment.

FIG. 9 is a flowchart showing one example of the attribute and kind determination process of the vehicle communication device 10. The vehicle communication device 10 determines whether the circumstance information is received by the first connecting means 14 or not by the control of the controlling means 11 for executing the computer program 100 (S101), and when it is determined that the circumstance information is received (S101:YES), it determines the attribute of the received circumstance information (S102). At the step S102, determination is made based on the data stored in the attribute identifier storage field and when the stored data is "0x01", it is determined that the circumstance information is the operation information showing the circumstance regarding the driving operation transmitted from the operation detection device 30, or when the stored data is "0x02", it is determined that the circumstance information is the cruising information showing the circumstance regarding the cruising condition transmitted from the cruising detection device 40, or when the stored data is "0x03", it is determined that the circumstance information is the environment information showing the circumstance regarding the road transmitted from the environment detection device 50.

When it is determined that the circumstance information is not received at the step S101 (S101:NO), the vehicle communication device 10 repeats the above operation at the step S101 by the control of the controlling means 11.

When it is determined that the circumstance information is the operation information at the step S102 (S102:1), the vehicle communication device 10 determines the kind of the circumstance information regarding the received operation information by the control of the controlling means 11 (S103). At the step S103, the determination is made based on the data stored in the information identifier storage field, and when the stored data is "0x01", it is determined that the circumstance information regards the direction indicator operation or when it is "0x02", it is determined that the circumstance information regards the headlight operation.

When it is determined that the circumstance information is the circumstance information regarding the direction indicator operation at the step S103 (S103:1), the vehicle communication device 10 starts a first analysis process for analyzing the circumstance regarding the direction indicator operation by the control of the controlling means 11 (S104).

When it is determined that the circumstance information is the circumstance information regarding the headlight operation at the step S103 (S103:2), the vehicle communication device 10 starts a second analysis process for analyzing the circumstance regarding the headlight operation by the control of the controlling means 11 (S105).

When it is determined that the circumstance information is the cruising information at the step S102 (S102:2), the vehicle communication device 10 determines the kind of the circumstance information regarding the received cruising information by the control of the controlling means 11 (S106). At the step S106, the determination is made based on the data stored in the information identifier storage field, and when the stored data is "0x03", it is determined that the circumstance information regards the cruising speed or when it is "0x04", it is determined that the circumstance information regards the distance between the vehicles.

When it is determined that the circumstance information is the circumstance information regarding the cruising speed at the step S106 (S106:1), the vehicle communication device 10 starts a third analysis process for analyzing the circumstance regarding the cruising speed by the control of the controlling means 11 (S107).

When it is determined that the circumstance information is the circumstance information regarding the distance between the vehicles at the step S106 (S106:2), the vehicle communication device 10 starts a fourth analysis process for analyzing the circumstance regarding the distance between the vehicles by the control of the controlling means 11 (S108).

When it is determined that the circumstance information is the road information at the step S102 (S102:3), the vehicle communication device 10 determines the kind of the circumstance information regarding the received road information by the control of the controlling means 11 (S109). At the step S109, the determination is made based on the data stored in the information identifier storage field, and when the stored data is "0x05", it is determined that the circumstance information regards the road segment or when it is "0x06", it is determined that the circumstance information regards the positional relation with another road, or when it is "0x07", it is determined that the circumstance information regards the traffic lane position.

When it is determined that the circumstance information is the circumstance information regarding the road segment at the step S109 (S109:1), the vehicle communication device 10 starts a fifth analysis process for analyzing the circumstance regarding the road segment by the control of the controlling means 11 (S110).

When it is determined that the circumstance information is the circumstance information regarding the positional relation with another road at the step S109 (S109:2), the vehicle communication device 10 starts a sixth analysis process for analyzing the circumstance regarding the positional relation by the control of the controlling means 11 (S111).

When it is determined that the circumstance information is the circumstance information regarding the traffic lane position at the step S109 (S109:3), the vehicle communication device 10 starts a seventh analysis process for analyzing the circumstance regarding the traffic lane position by the control of the controlling means 11 (S112). In this way, the attribute and kind determination processes are executed.

Figure 10:
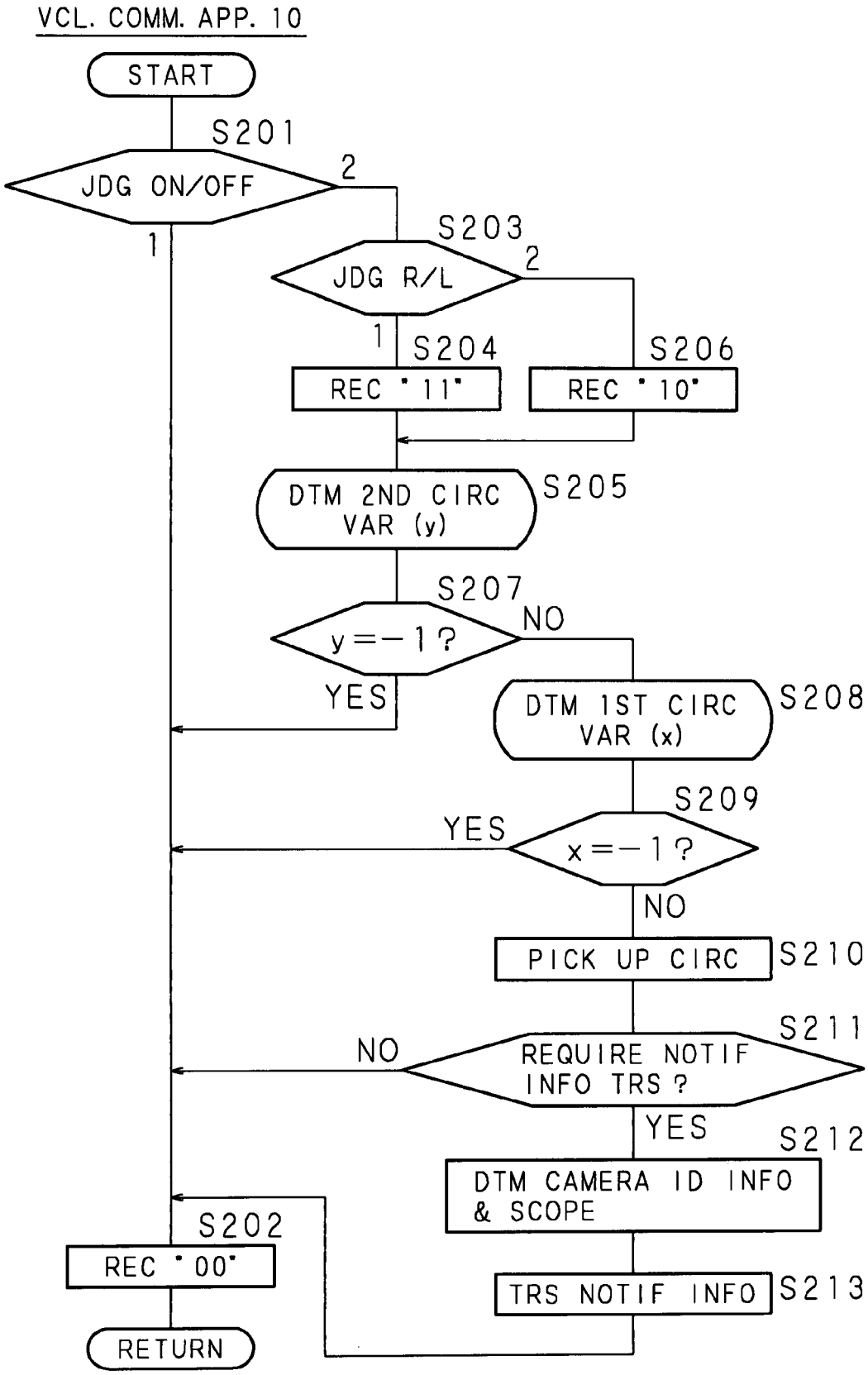
FIG. 10 is a flowchart showing one example of a first analysis process of the vehicle communication device according to an embodiment.

FIG. 10 is a flowchart showing one example of the first analysis process of the vehicle communication device 10. The first analysis process is started at the step S104 for determining the attribute and the kind described with reference to FIG. 9. The vehicle communication device 10 determines whether the operation of the direction indicator designated by the received circumstance information is an on operation or off operation by the control of the controlling means 11 for executing the computer program 100 (S201). At the step S201, the determination is made based on the data stored in the data field, and when the data stored as the bit 1 is "0", the operation is determined as the off operation or when it is "1", the operation is determined as the on operation.

At the step S201, when the off operation is determined (S201:1), the vehicle communication device 10 records "0" and "0" to the bit1 and the bit0 regarding the direction indicator operation in the detection circumstance table 12*a* by the control of the controlling means 11 (S202), and completes the first analysis process without transmitting the notification information.

St the step S201, when on operation is determined (S201:2), the vehicle communication device 10 determines whether the operation is for the right indicator or the left indicator by the control of the controlling means 11 (S203). At the step S203, determination is made based on the data stored in the data field and when the data stored as the bit0 is "0", it is determined that the operation is for the left indicator, or when it is "1", it is determined that the operation for the right indicator.

At the step S203, when it is determined that the operation is for the right direction indicator (S203:1), the vehicle communication device 10 records "1" and "1" to the bit1 and the bit0 regarding the direction indicator operation in the detection circumstance table 12*a* by the control of the controlling means 11 (S204), and performs a second circumstance variable determination process (S205). The second circumstance variable determination process at the step S205 is a process for determining the second circumstance variable (y) used in the circumstance determination table 12*b*. This second circumstance variable determination process will be described later.

At the step S203, when it is determined that the operation is for the left direction indicator (S203:2), the vehicle communication device 10 records "1" and "0" to the bit1 and the bit0 regarding the direction indicator operation in the detection circumstance table 12*a* by the control of the controlling means 11 (S206), and performs the second circumstance variable determination process (S205).

After the execution of the second circumstance variable determination process at the step S205, it is determined whether the second circumstance variable (y) is "−1" or not by the control of the controlling means 11 (S207). When "−1" is set to the second circumstance variable (y), it is not necessary to notice another vehicle of the notification information, for example, "−1" is set to the second circumstance variable (y), when, in operation of the indicator, the speed is not less than 6 km/h and less than 40 km/h, or when, at blinking of the headlamp, the speed is not less than 6 km/h and less than 40 km/h, or when both the speed is not less than 40 km/h and the vehicle in back is beyond 3 m. In addition, the case where the second circumstance variable (y) is "−1" is not shown in the circumstance determination table 12*b* shown in FIG. 4.

At the step S207, when the second variable (y) is "−1" (S207:YES), the vehicle communication device 10 proceeds to step S202 by the control of the controlling means 11 and the vehicle communication device 10 records "0" and "0" to the bit1 and the bit0 regarding the direction indicator operation in the detection circumstance table 12*a* by the control of the controlling means 11 (S202), and completes the first analysis process without transmitting the notification information. The process at the step S202 in this case is an initializing process for the bit1 and bit0 regarding the direction indicator operation in the detection circumstance table 12*a*.

At the step S207, when the second circumstance variable (y) is the number other than "−1" (S207:NO), the vehicle communication device 10 performs a first circumstance variable determination process (S208) by the control of the controlling means 11. The first circumstance variable determination process at the step S208 is a process for determining the first circumstance variable (x) used in the circumstance determination table 12*b*. This first circumstance variable determination process will be described later.

After the execution of the first circumstance variable determination process at the step S208, the vehicle communication device 10 determines whether the first circumstance variable (x) is "−1" or not by the control of the controlling means 11 (S209). For example, "−1" is set to the first circumstance variable (x), when the vehicle runs in the expressway and its lane position is neither the left lane or center lane or right lane, i.e. in the case that the vehicle runs in the parking area or service area, which does not include any cruising lane. In addition, the case where the first circumstance variable (x) is "−1" is not shown in the circumstance determination table 12*b* shown in FIG. 4.

At the step S209, when the first variable (x) is "−1" (S209: YES), the vehicle communication device 10 proceeds to step S202 by the control of the controlling means 11 and the vehicle communication device 10 records "0" and "0" to the bit1 and the bit0 regarding the direction indicator operation in the detection circumstance table 12*a* by the control of the controlling means 11 (S202), and completes the first analysis process without transmitting the notification information. The process at the step S202 in this case is the initializing process for the bit1 and bit0 regarding the direction indicator operation of the detection circumstance table 12*a*.

At the step S209, when the first circumstance variable (x) is the number other than "−1" (S209:NO), the vehicle communication device 10 derives the circumstance of the vehicle 1 based on the information regarding the driving operation, the information regarding the cruising condition, and the information regarding the cruising road and the circumstance determination table 12*b* by the control of the controlling means 11 (S210). At the step S210, as the process for deriving the circumstance of the vehicle 1, the number corresponding to the combination of the first circumstance variable (x) and the second circumstance variable (y) is derived from the circumstance determination table 12*b* as the number showing the circumstance of the vehicle 1. For example, when the first circumstance variable (x) is "3" and the second circumstance variable (y) is "1", the number showing the circumstance of the vehicle 1 is "5". In addition, the controlling means 11 processes the number showing the circumstance of the vehicle 1 as a circumstance variable A[x][y], for example A[3][1]=5 in the table shown in FIG. 4.

Then, the vehicle communication device 10 determines whether the notification information needs to be transmitted or not based on the derived circumstance of the vehicle 1 (S211). At the step S211, when the number showing the circumstance of the vehicle 1 is "0", that is, when the circumstance variable A[x][y]=0, it is determined that the notification information needs not to be transmitted, or when the number is not "0", it is determined that the notification information needs to be transmitted.

When it is determined that the notification information needs not to be transmitted (A[x][y]=0) at the step S211 (S211:NO), the proceeds to step S202 by the control of the controlling means 11 and records "0" and "0" to the bit1 and bit0 regarding the direction indicator operation in the detection circumstance table 12*a* (S202) and completes the first analysis process without transmitting the notification information. The process at the step S202 in this case is the initializing process of the bit1 and the bit0 regarding the direction indicator operation in the detection circumstance table 12*a*.

When it is determined that the notification information needs to be transmitted at the step S211 (S211:YES), the vehicle communication device 10 determines the imaging device identification information for identify the imaging device 20 and the area that becomes the effective range in the shooting range of the imaging device 20 based on the number (A[x][y]) showing the circumstance of the vehicle 1 and the direction determination table 12*c* by the control of the controlling means 11 (S212). The process at the step S212 is a process for determine the direction in which the existence of another vehicle is to be confirmed based on the detected circumstance of the vehicle 1.

Then, the vehicle communication device 10 starts the notification information transmission process for determining the notification information, determining the destination of the notification information and transmitting the notification information by the control of the controlling means 11 (S213) and then proceeds to step S202 to record "0" and "0" to the bit1 and bit0 regarding the direction indicator operation in the detection circumstance table 12*a* and finishes the first analysis process. When the notification information transmission process is performed at the step S213, the circumstance variable A[x][y] showing the circumstance of the vehicle 1 and the variable designating the imaging device identification information and the effective range determined at the step S212 are stored in the storing means 13 and passed to a program module for executing the notification information transmission process. Thus, after the vehicle communication device 10 has passed the variables to the program module for the notification information transmission process, it initializes the detection circumstance table 12*a* at the step S202. Thus, the first analysis process is executed.

Figure 11:
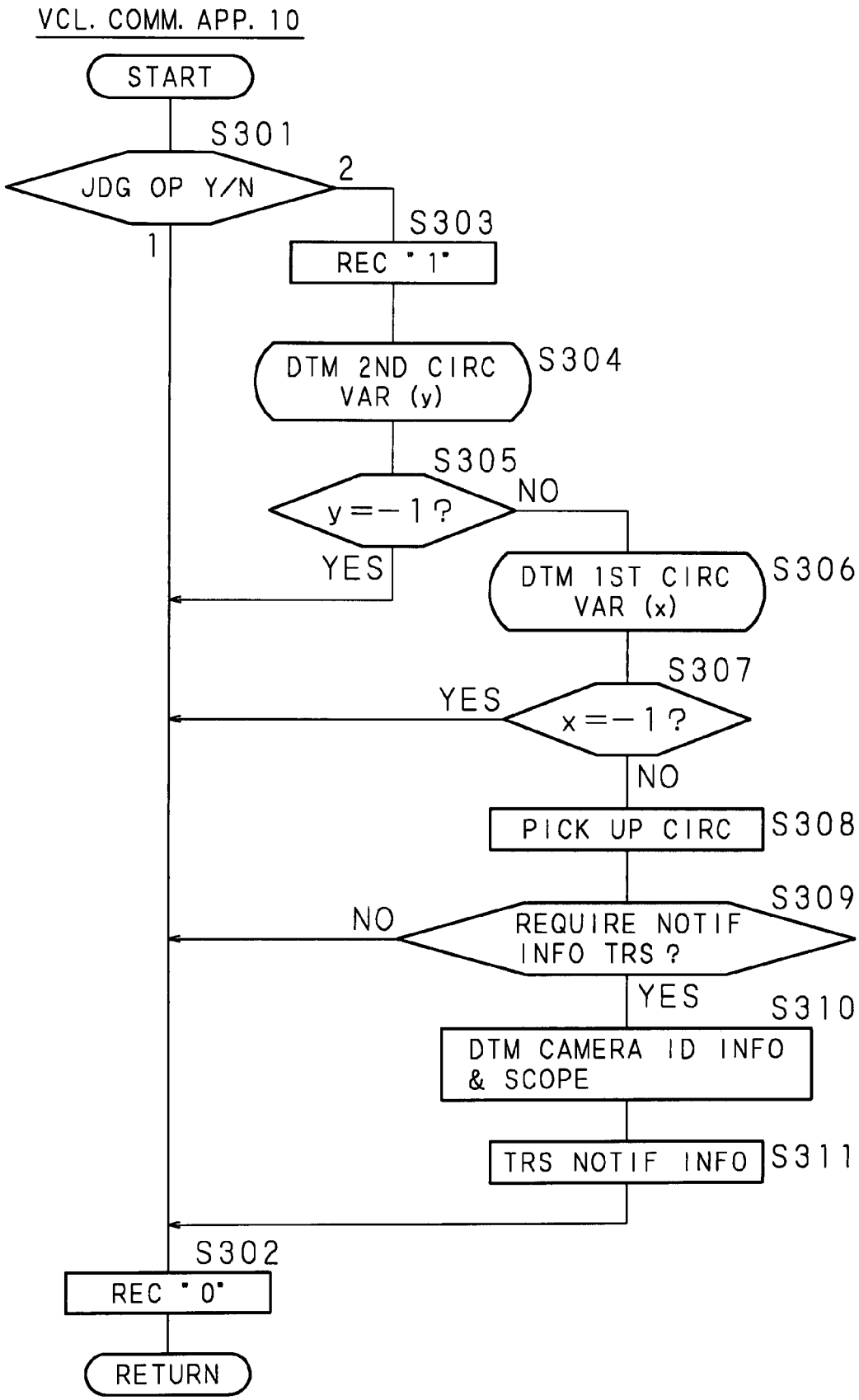
FIG. 11 is a flowchart showing one example of a second analysis process of the vehicle communication device according to an embodiment.

FIG. 11 is a flowchart showing one example of the second analysis process of the vehicle communication device 10. The second analysis process is started at the step S105 for the attribute and kind determination process described with reference to FIG. 9. The vehicle communication device 10 determines whether there is a headlight operation shown by the received circumstance information or not by the control of the controlling means 11 that executes the computer program 100 (S301). At the step S301, the determination is made based on the data stored in the data field and when the data stored as the bit0 is "1", it is determined that the operation has been performed or when it is "0", it is determined that the operation has not been performed.

When it is determined that the operation has not been performed at the step S301 (S301:1), the vehicle communication device 10 records "0" to the bit0 regarding the headlight operation in the detection circumstance table 12*a* (S302) by the control of the controlling means 11 and completes the second analysis process without transmitting the notification information.

When it is determined that the operation has been performed at the step S301 (S301:2), the vehicle communication device 10 records "1" to the bit0 regarding the headlight operation in the detection circumstance table 12*a* (S303) by the control of the controlling means 11 and performs the second circumstance variable determination process (S304).

After the vehicle communication device 10 has executed the second circumstance variable determination process at the step S304, it is determined whether the second circumstance variable (y) is "−1" or not by the control of the controlling means 11 (S305).

When the second circumstance variable (y) is "−1" at the step S305 (S305:YES), the vehicle communication device 10 proceeds to step S302 and records "0" to the bit0 regarding the headlight operation in the detection circumstance table 12*a* (S302) by the control of the controlling means 11 and completes the second analysis process without transmitting the notification information. The process at the step S302 in this case is an initializing process for the bit0 regarding the headlight operation in the detection circumstance table 12*a*.

When the second circumstance variable (y) is not "−1" at the step S305 (S305:NO), the vehicle communication device 10 performs the first circumstance variable determination process by the control of the controlling means 11 (S306).

After the vehicle communication device 10 has executed the first circumstance variable determination process at the step S306, it is determined whether the first circumstance variable (x) is "−1" or not by the control of the controlling means 11 (S307).

When the first circumstance variable (x) is "−1" at the step S307 (S307:YES), the vehicle communication device 10 proceeds to step S302 and records "0" to the bit0 regarding the headlight operation in the detection circumstance table 12*a* (S302) by the control of the controlling means 11 and completes the second analysis process without transmitting the notification information. The process at the step S302 in this case is the initializing process for the bit0 regarding the headlight operation in the detection circumstance table 12*a*.

At the step S307, when the first circumstance variable (x) is the number other than "−1" (S307:NO), the vehicle communication device 10 derives the circumstance of the vehicle 1 based on the information regarding the driving operation, the information regarding the cruising condition, and the information regarding the cruising road and the circumstance determination table 12*b* by the control of the controlling means 11 (S308). At the step S308, as the process for deriving the circumstance of the vehicle 1, the number corresponding to the combination of the first circumstance variable (x) and the second circumstance variable (y) is derived from the circumstance determination table 12*b* as the number showing the circumstance of the vehicle 1. In addition, the number designating the circumstance of the vehicle 1 is handled as the circumstance variable A[x][y].

Then, the vehicle communication device 10 determines whether the notification information needs to be transmitted or not by the control of the controlling means 11 based on the derived circumstance of the vehicle 1 (S309). At the step S309, when the number showing the circumstance of the vehicle 1 is "0", that is, when the circumstance variable A[x][y]=0, it is determined that the notification information needs not to be transmitted, or when the number is not "0", it is determined that the notification information needs to be transmitted.

When it is determined that the notification information needs not to be transmitted (A[x][y]=0) at the step S309 (S309:NO), the vehicle communication device 10 proceeds to step S302 by the control of the controlling means 11 and records "0" to the bit0 regarding the headlight operation in the detection circumstance table 12*a* (S302) and completes the second analysis process without transmitting the notification information. The process at the step S302 in this case is the initializing process in the detection circumstance table 12*a*.

When it is determined that the notification information needs to be transmitted at the step S309 (S309:YES), the vehicle communication device 10 determines the imaging device identification information for identify the imaging device 20 and the area that becomes the effective range in the shooting range of the imaging device 20 based on the number (A[x][y]) showing the circumstance of the vehicle 1 and the direction determination table 12*c* by the control of the controlling means 11 (S310).

Then, the vehicle communication device 10 starts the notification information transmission process for determining the notification information, determining the destination of the notification information and transmitting the notification information by the control of the controlling means 11 (S311) and then proceeds to step S302 to record "0" to the bit0 regarding the headlight operation in the detection circumstance table 12*a* and finishes the second analysis process. When the notification information transmission process is performed at the step S311, the circumstance variable A[x][y] showing the circumstance of the vehicle 1 and the variable designating the imaging device identification information and the effective range determined at the step S310 are stored in the storing means 13 and passed to the program module for executing the notification information transmission process.

Thus, after the vehicle communication device 10 has passed the variables to the program module for the notification information transmission process, it initializes the detection circumstance table 12*a* at the step S302. Thus, the second analysis process is executed.

Figure 12:
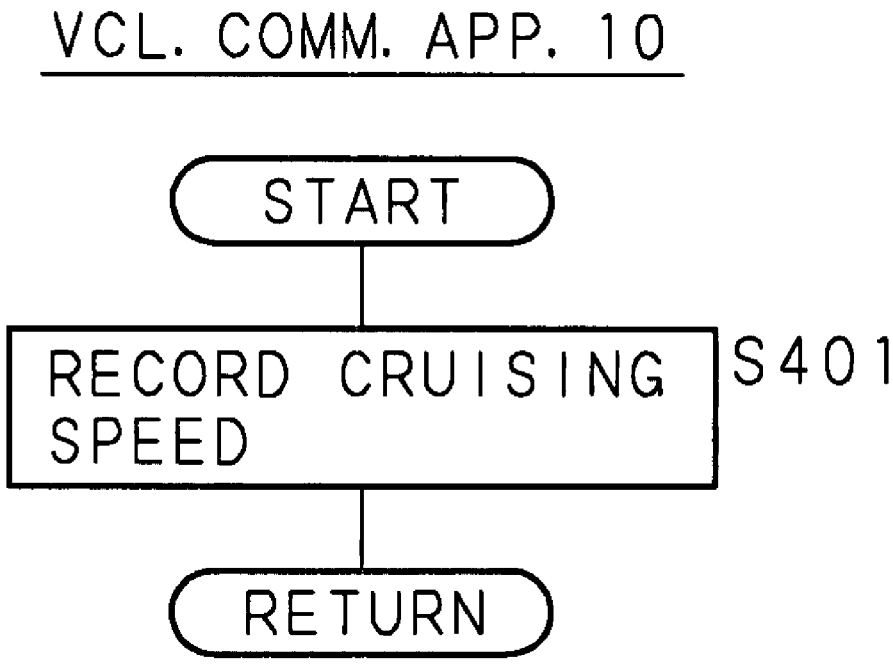
FIG. 12 is a flowchart showing one example of a third analysis process of the vehicle communication device according to an embodiment.

FIG. 12 is a flowchart showing one example of the third analysis process of the vehicle communication device 10. The third analysis process is started at the step S107 for the attribute and kind determination process described with reference to FIG. 9. The vehicle communication device 10 records the cruising speed based on the data stored in the data field of the received circumstance information to the bit0 to bit15 regarding the cruising speed in the detection circumstance table 12*a* by the control of the controlling means 11 that executes the computer program 100 (S401) and completes the third analysis process.

Figure 13:
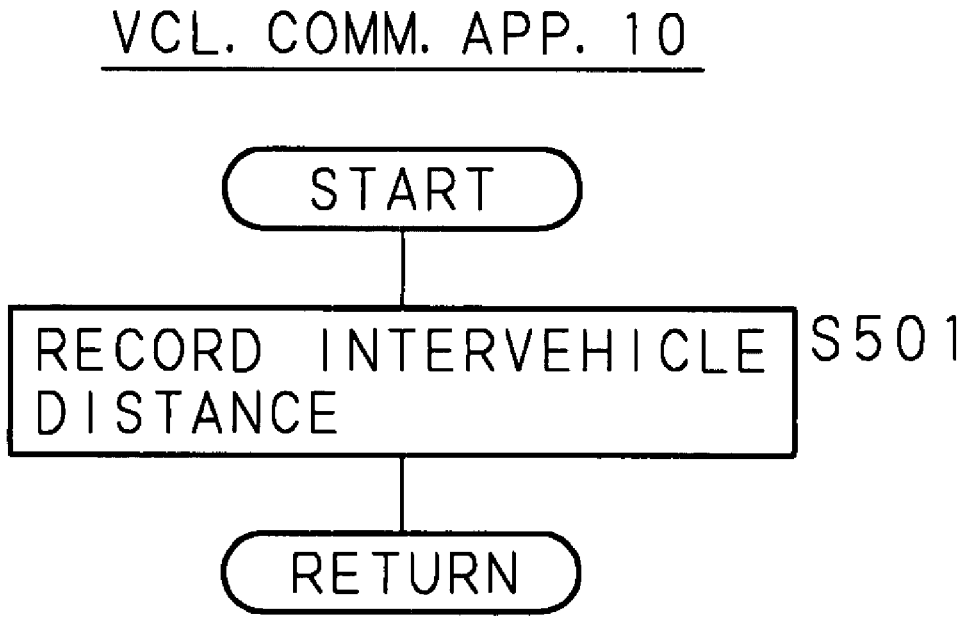
FIG. 13 is a flowchart showing one example of a fourth analysis process of the vehicle communication device according to an embodiment.

FIG. 13 is a flowchart showing one example of the fourth analysis process of the vehicle communication device 10. The fourth analysis process is started at the step S108 for the attribute and kind determination process described with reference to FIG. 9. The vehicle communication device 10 records the distance between the vehicles based on the data stored in the data field of the received circumstance information to the bit0 to bit31 regarding the distance between the vehicles in the detection circumstance table 12*a* by the control of the controlling means 11 that executes the computer program 100 (S501) and completes the fourth analysis process.

Figure 14:
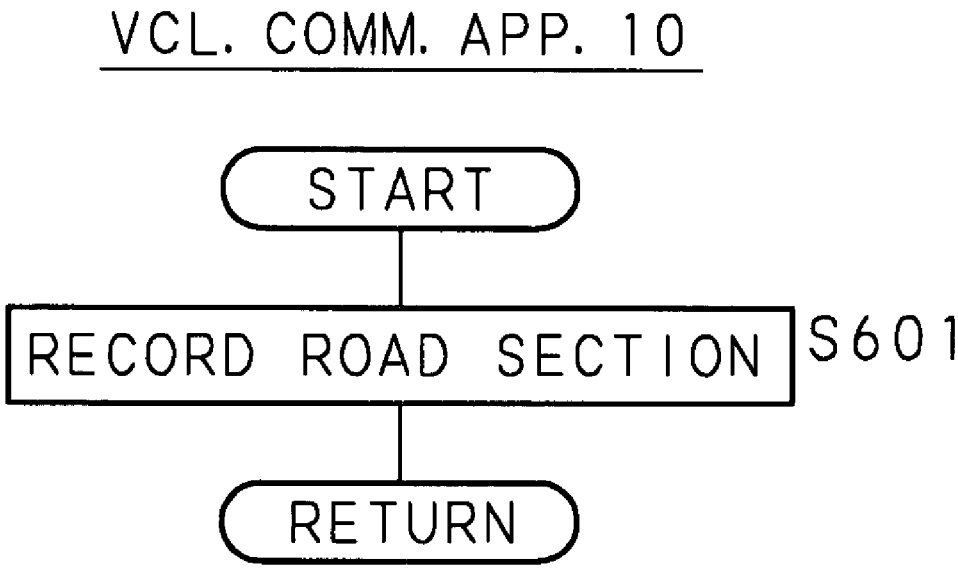
FIG. 14 is a flowchart showing one example of a fifth analysis process of the vehicle communication device according to an embodiment.

FIG. 14 is a flowchart showing one example of the fifth analysis process of the vehicle communication device 10. The fifth analysis process is started at the step S110 for the attribute and kind determination process described with reference to FIG. 9. The vehicle communication device 10 records the road segment based on the data stored in the data field of the received circumstance information to the bit0 to bit1 regarding the road segment in the detection circumstance table 12*a* by the control of the controlling means 11 that executes the computer program 100 (S601) and completes the fifth analysis process.

Figure 15:
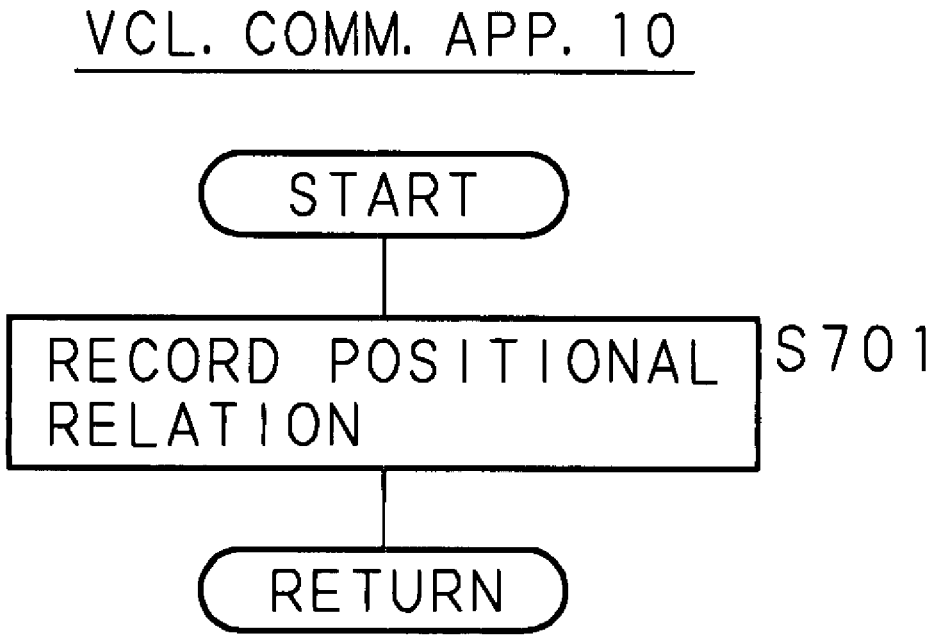
FIG. 15 is a flowchart showing one example of a sixth analysis process of the vehicle communication device according to an embodiment.

FIG. 15 is a flowchart showing one example of the sixth analysis process of the vehicle communication device 10. The sixth analysis process is started at the step S111 for the attribute and kind determination process described with reference to FIG. 9. The vehicle communication device 10 records the positional relation based on the data stored in the data field of the received circumstance information to the bit0 to bit1 regarding the positional relation in the detection circumstance table 12*a* by the control of the controlling means 11 that executes the computer program 100 (S701) and completes the sixth analysis process.

Figure 16:
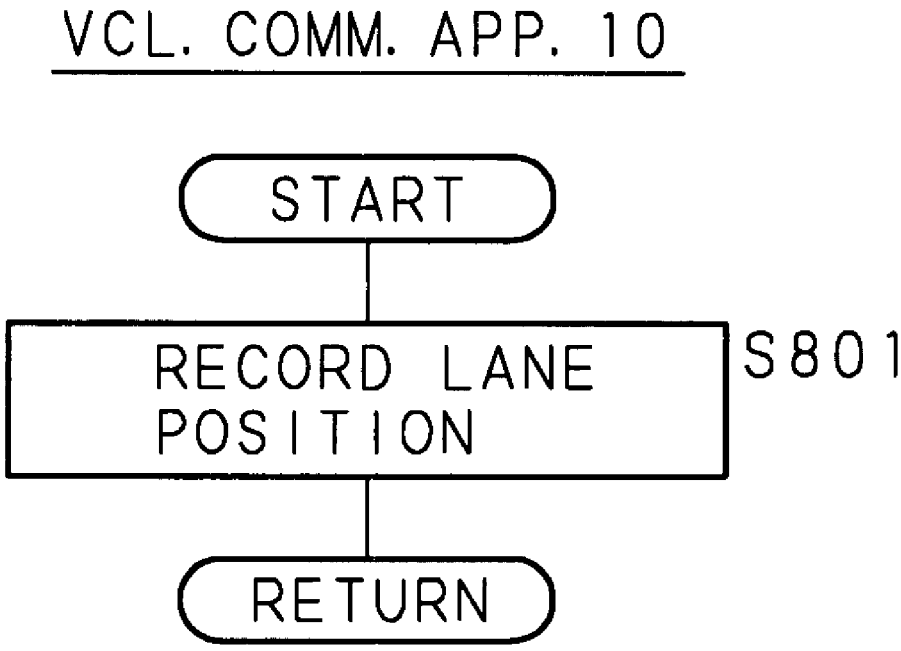
FIG. 16 is a flowchart showing one example of a seventh analysis process of the vehicle communication device according to an embodiment.

FIG. 16 is a flowchart showing one example of the seventh analysis process of the vehicle communication device 10. The seventh analysis process is started at the step S112 for the attribute and kind determination process described with reference to FIG. 9. The vehicle communication device 10 records the traffic lane position based on the data stored in the data field of the received circumstance information to the bit0 to bit2 regarding the traffic lane position in the detection circumstance table 12*a* by the control of the controlling means 11 that executes the computer program 100 (S801) and completes the seventh analysis process.

Figure 17:
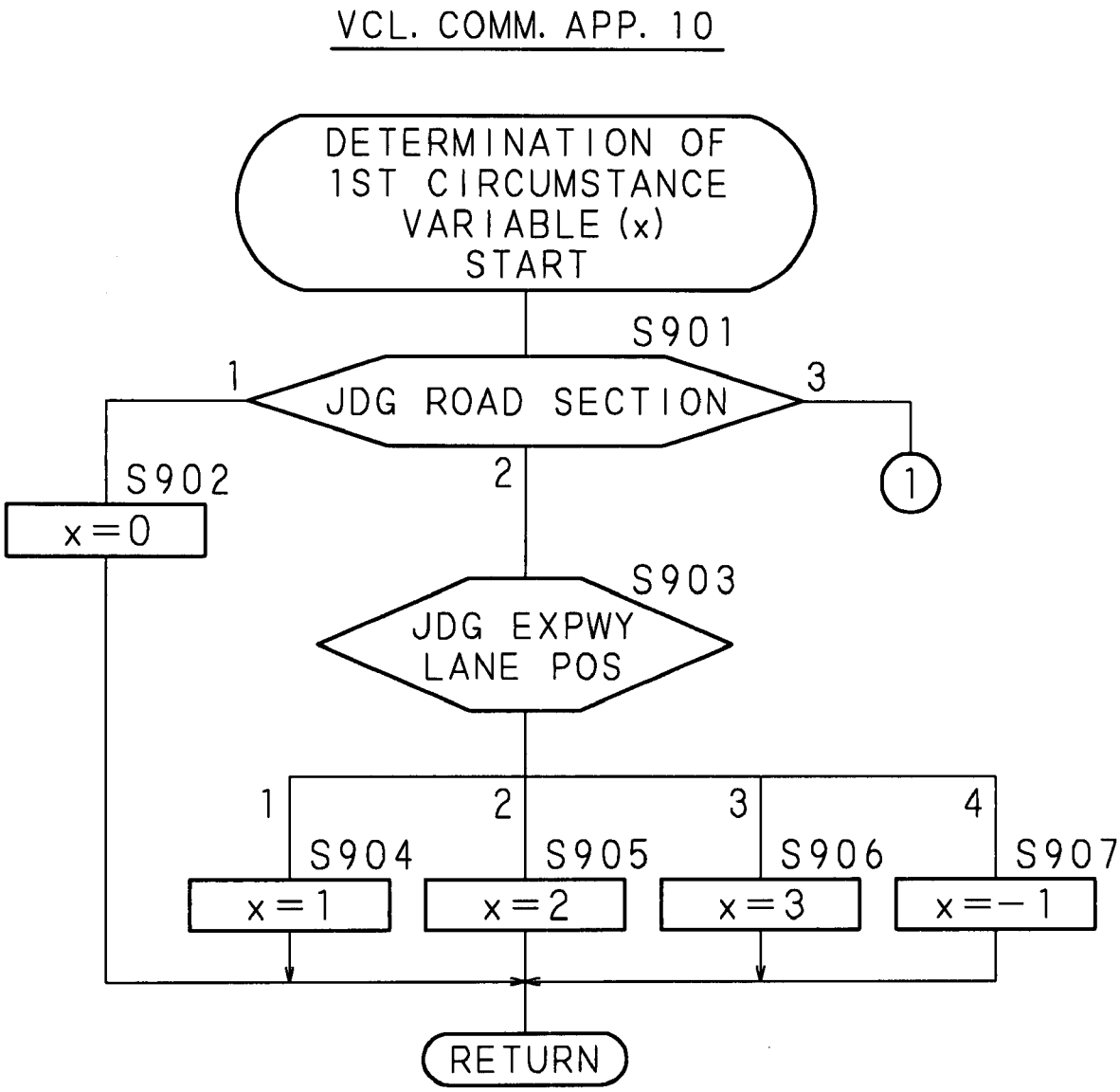
FIG. 17 is a flowchart showing one example of a first circumstance variable determination process of the vehicle communication device according to an embodiment.
Figure 18:
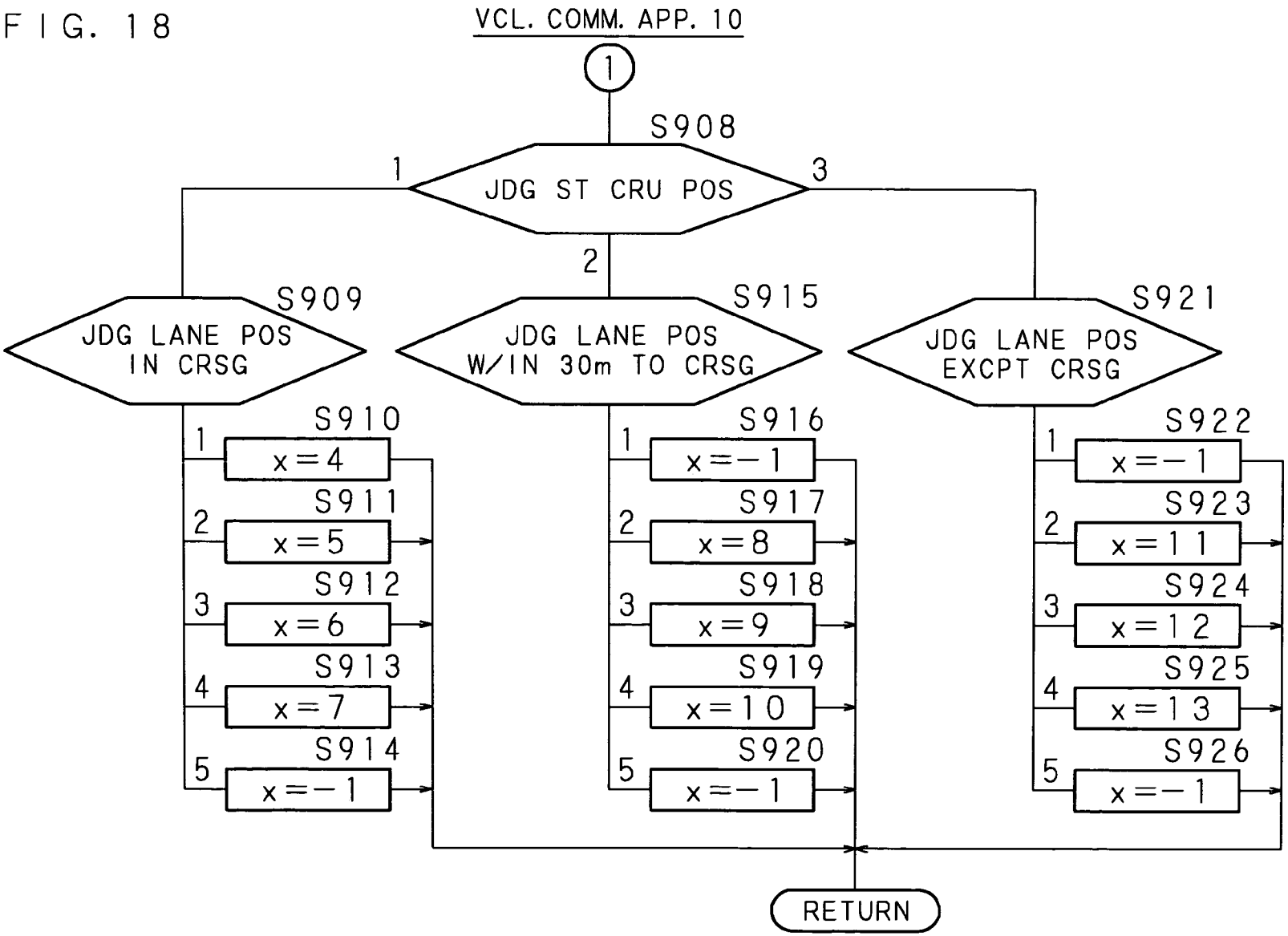
FIG. 18 is a flowchart showing one example of the first circumstance variable determination process of the vehicle communication device according to an embodiment.

FIGS. 17 and 18 are flowcharts showing one example of the first circumstance variable determination process of the vehicle communication device 19. The first circumstance variable determination process is started at the step S208 described with reference to FIG. 10 or at the step S306 described with reference to FIG. 11. The vehicle communication device 10 determines the road segment by the control of the controlling means 1 that executes the computer program 100 based on the detection circumstance table 12*a* (S901).

When it is determined that the road segment is other than the general road and the express way at the step S901 (S901:1), the vehicle communication device 10 determines the first circumstance variable (x) to be "0" by the control of the controlling means 11 (S902) and completes the first circumstance variable determination process.

When it is determined that the road segment is the express way at the step S902 (S902:2), the vehicle communication device 10 determines the traffic lane position based on the detection circumstance table 12*a* by the control of the controlling means 11 (S903).

When it is determined that the traffic lane position is the left lane at the step S903 (S903:1), the vehicle communication device 10 determines the first circumstance variable (x) to be "1" by the control of the controlling means 11 (S904) and completes the first circumstance variable determination process.

When it is determined that the traffic lane position is the center lane at the step S903 (S903:2), the vehicle communication device 10 determines the first circumstance variable (x) to be "2" by the control of the controlling means 11 (S905) and completes the first circumstance variable determination process.

When it is determined that the traffic lane position is the right lane at the step S903 (S903:3), the vehicle communication device 10 determines the first circumstance variable (x) to be "3" by the control of the controlling means 11 (S906) and completes the first circumstance variable determination process.

When it is determined that the traffic lane position is neither the left lane nor the center lane nor the right lane at the step S903 (S903:4), the vehicle communication device 10 determines the first circumstance variable (x) to be "−1" by the control of the controlling means 11 (S907) and completes the first circumstance variable determination process.

When it is determined that the road segment is the general road at the step S901 (S901:3), the vehicle communication device 10 determines the positional relation (cruising position) to another road by the control of the controlling means 11 based on the detection circumstance table 12*a* (S908).

When it is determined that the position is in the intersection at the step S908 (S908:1), the vehicle communication device 10 determines the traffic lane position based on the bit0 to bit2 regarding the traffic lane position in the detection circumstance table 12*a* by the control of the controlling means 11 (S909).

When it is determined that the traffic lane position is the right turn lane at the step S909 (S909:1), the vehicle communication device 10 determines the first circumstance variable (x) to be "4" by the control of the controlling means 11 (S910) and completes the first circumstance variable determination process.

When it is determined that the traffic lane position is the left lane at the step S909 (S909:2), the vehicle communication device 10 determines the first circumstance variable (x) to be "5" by the control of the controlling means 11 (S911) and completes the first circumstance variable determination process.

When it is determined that the traffic lane position is the center lane at the step S909 (S909:3), the vehicle communication device 10 determines the first circumstance variable (x) to be "6" by the control of the controlling means 11 (S912) and completes the first circumstance variable determination process.

When it is determined that the traffic lane position is the right lane at the step S909 (S909:4), the vehicle communication device 10 determines the first circumstance variable (x) to be "7" by the control of the controlling means 11 (S913) and completes the first circumstance variable determination process.

When it is determined that the traffic lane position is neither the right turn lane nor the left lane nor the center lane at the step S909 (S909:5), the vehicle communication device 10 determines the first circumstance variable (x) to be "−1" by the control of the controlling means 11 (S914) and completes the first circumstance variable determination process.

When it is determined that the position is within 30 m before the intersection at the step S908 (S908:2), the vehicle communication device 10 determines the lane portion based on the bit0 to bit2 regarding the traffic lane position of the detection circumstance table 12*a* by the control of the controlling means 11 (S915).

When it is determined that the traffic lane position is the right turn lane at the step S915 (S915:1), the vehicle communication device 10 determines the first circumstance variable (x) to be "−1" by the control of the controlling means 11 (S916) and completes the first circumstance variable determination process.

When it is determined that the traffic lane position is the left lane at the step S915 (S915:2), the vehicle communication device 10 determines the first circumstance variable (x) to be "8" by the control of the controlling means 11 (S917) and completes the first circumstance variable determination process.

When it is determined that the traffic lane position is the center lane at the step S915 (S915:3), the vehicle communication device 10 determines the first circumstance variable (x) to be "9" by the control of the controlling means 11 (S918) and completes the first circumstance variable determination process.

When it is determined that the traffic lane position is the right lane at the step S915 (S915:4), the vehicle communication device 10 determines the first circumstance variable (x) to be "10" by the control of the controlling means 11 (S919) and completes the first circumstance variable determination process.

When it is determined that the traffic lane position is neither the right turn lane, the left lane, the center lane nor the right lane at the step S915 (S915:5), the vehicle communication device 10 determines the first circumstance variable (x) to be "−1" by the control of the controlling means 11 (S920) and completes the first circumstance variable determination process.

When it is determined that the position is neither in the intersection nor within 30 m before the intersection at the step S908 (S908:3), the vehicle communication device 10 determines the lane portion based on the bit0 to bit2 regarding the traffic lane position in the detection circumstance table 12*a* by the control of the controlling means 11 (S921).

When it is determined that the traffic lane position is the right turn lane at the step S921 (S921:1), the vehicle communication device 10 determines the first circumstance variable (x) to be "−1" by the control of the controlling means 11 (S922) and completes the first circumstance variable determination process.

When it is determined that the traffic lane position is the left lane at the step S921 (S921:2), the vehicle communication device 10 determines the first circumstance variable (x) to be "11" by the control of the controlling means 11 (S923) and completes the first circumstance variable determination process.

When it is determined that the traffic lane position is the center lane at the step S921 (S921:3), the vehicle communication device 10 determines the first circumstance variable (x) to be "12" by the control of the controlling means 11 (S924) and completes the first circumstance variable determination process.

When it is determined that the traffic lane position is the right lane at the step S921 (S921:4), the vehicle communication device 10 determines the first circumstance variable (x) to be "13" by the control of the controlling means 11 (S925) and completes the first circumstance variable determination process.

When it is determined that the traffic lane position is neither the right turn lane, the left lane, the center lane nor the right lane at the step S921 (S921:5), the vehicle communication device 10 determines the first circumstance variable (x) to be "−1" by the control of the controlling means 11 (S926) and completes the first circumstance variable determination process.

Figure 19:
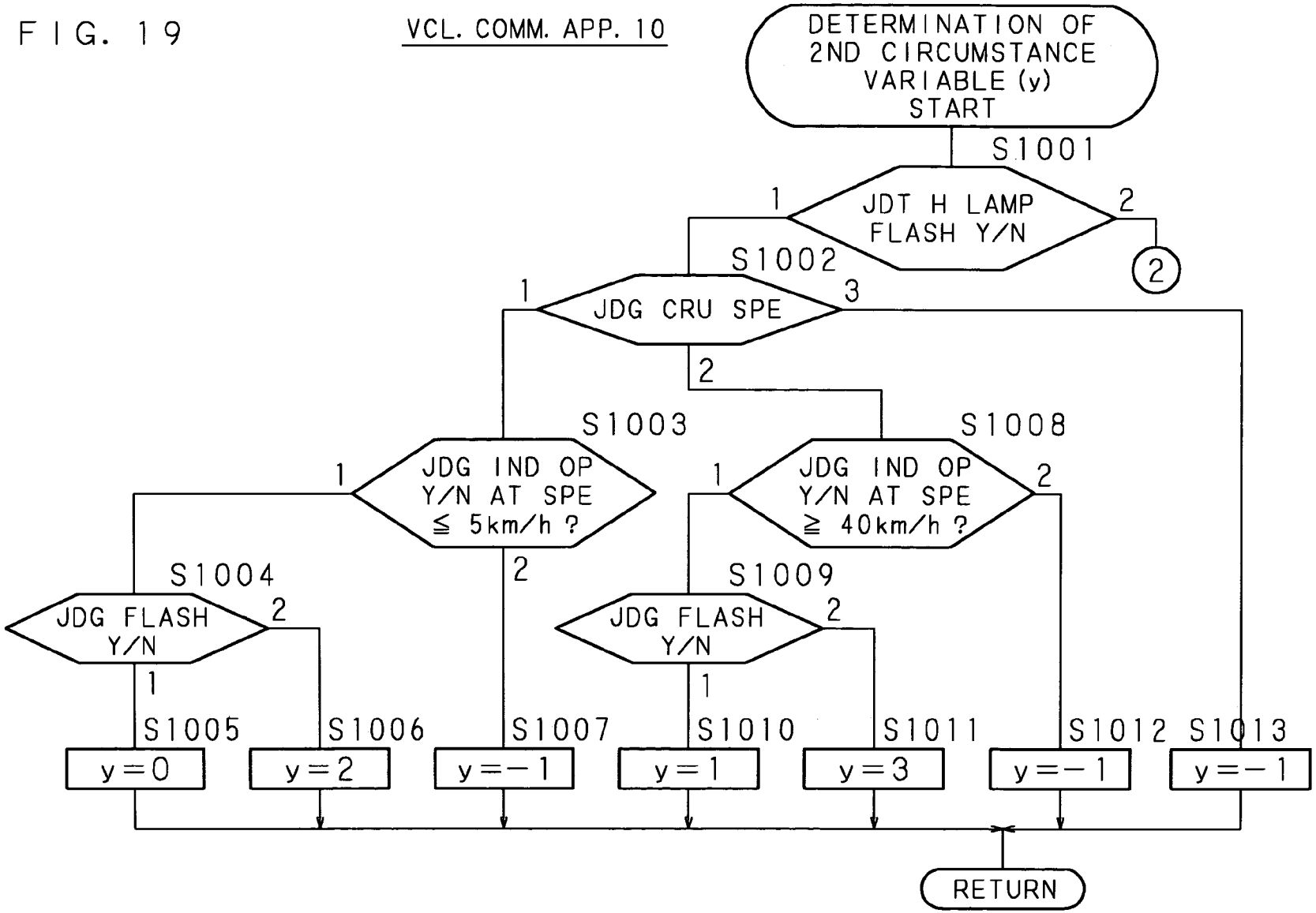
FIG. 19 is a flowchart showing one example of a second circumstance variable determination process of the vehicle communication device according to an embodiment.
Figure 20:
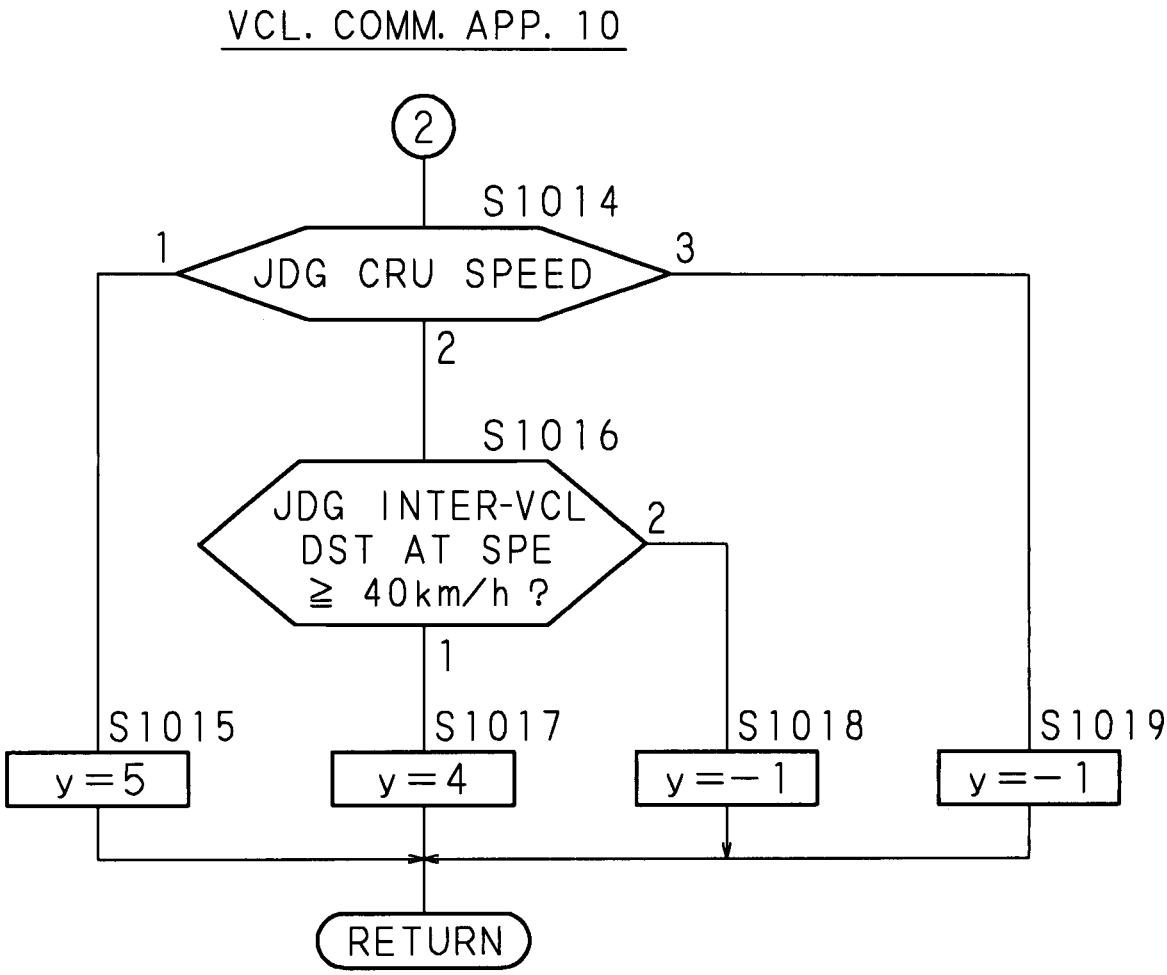
FIG. 20 is a flowchart showing one example of the second circumstance variable determination process of the vehicle communication device according to an embodiment.

FIGS. 19 and 20 are flowcharts showing one example of the second circumstance variable determination process of the vehicle communication device 10. The second circumstance variable determination process is started at the step S205 described with reference to FIG. 10 or at the step S304 described with reference to FIG. 11. The vehicle communication device 10 determines whether the headlight is operated or not by the control of the controlling means 1 that executes the computer program 100 (S1001).

When it is determined that the headlight is not operated at the step S1001 (S1001:1), the vehicle communication device 10 determines the cruising (traveling) speed based on the bit0 to bit15 regarding the cruising (traveling) speed in the detection circumstance table 12*a* by the control of the controlling means 11 (S1002). The determination of the cruising (traveling) speed at the step S1002 is a process in which it is determined whether the cruising (traveling) speed is not more than 5 km/h or not less than 40 km/h or neither of them.

When it is determined that the cruising speed is not more than 5 km/h at the step S1002 (S1002:1), the vehicle communication device 10 determines the direction indicator operation based on the bit1 regarding the direction indicator operation in the detection circumstance table 12*a* by the control of the controlling means 11 (S1003). The determination of the direction indicator operation at the step S1003 is a process in which it is determined whether the on operation is performed or off operation is performed. Since this determination is made based on the detection circumstance table 12*a*, when the operation is not performed, the data of the bit1 is "0", so that off operation can be determined.

When it is determined that the on operation has been performed at the step S1003 (S1003:1), the vehicle communication device 10 determines that either right or left of the indicator is turned on based on the bit0 regarding the direction indicator operation in the detection circumstance table 12*a* by the control of the controlling means 11 (S1004).

When it is determined that the right direction indicator is turned on at the step S1004 (S1004:1), the vehicle communication device 10 determines the second circumstance variable (y) to be "0" by the control of the controlling means 11 (S1005) and completes the second circumstance variable determination process.

When it is determined that the left direction indicator is turned on at the step S1004 (S1004:2), the vehicle communication device 10 determines the second circumstance variable (y) to be "2" by the control of the controlling means 11 (S1006) and completes the second circumstance variable determination process.

When it is determined that the off operation has been performed at the step S1003 (S1003:2), the vehicle communication device 10 determines the second circumstance variable (y) to be "−1" by the control of the controlling means 11 (S1007) and completes the second circumstance variable determination process.

When it is determined that the cruising speed is not less than 40 km/h at the step S1002 (S1002:2), the vehicle communication device 10 determines the direction indicator operation based on the bit1 regarding the direction indicator operation in the detection circumstance table 12*a* by the control of the controlling means 11 (S1008).

When it is determined that the on operation has been performed at the step S1008 (S1008:1), the vehicle communication device 10 determines that either right or left of the indicator is turned on based on the bit0 regarding the direction indicator operation in the detection circumstance table 12*a* by the control of the controlling means 11 (S1009).

When it is determined that the right direction indicator is turned on at the step S1009 (S1009:1), the vehicle communication device 10 determines the second circumstance variable (y) to be "1" by the control of the controlling means 11 (S1010) and completes the second circumstance variable determination process.

When it is determined that the left direction indicator is turned on at the step S1009 (S1009:2), the vehicle communication device 10 determines the second circumstance variable (y) to be "3" by the control of the controlling means 11 (S1011) and completes the second circumstance variable determination process.

When it is determined that the off operation has been performed at the step S1008 (S1008:2), the vehicle communication device 10 determines the second circumstance variable (y) to be "−1" by the control of the controlling means 11 (S1012) and completes the second circumstance variable determination process.

When it is determined that the cruising speed is neither not more than 5 km/h nor less than 40 km/h at the step S1002 (S1002:3), the vehicle communication device 10 determines the second circumstance variable (y) to be "−1" by the control of the controlling means 11 (S1013) and completes the second circumstance variable determination process.

When it is determined that the headlight operation is performed at the step S1001 (S1001:2), the vehicle communication device 10 determines the cruising speed based on the bit0 to bit15 regarding the cruising speed in the detection circumstance table 12*a* by the control of the controlling means 11 (S1014).

When it is determined that the cruising speed is not more than 5 km/h at the step S1014 (S1014:1), the vehicle communication device 10 determines the second circumstance variable (y) to be "5" by the control of the controlling means 11 (S1015) and completes the second circumstance variable determination process.

When it is determined that the cruising speed is not less than 40 km/h at the step S1014 (S1014:2), the vehicle communication device 10 determines the distance between the vehicles based on the bit0 to bit31 regarding the distance between the vehicles in the detection circumstance table 12*a* by the control of the controlling means 11 (S1016). The determination of the distance between the vehicles at the step S1016 is a process in which it is determined whether the distance between the vehicles is less than 3 m or more than 3 m.

When it is determined that the distance between the vehicles is less than 3 m at the step S1016 (S1016:1), the vehicle communication device 10 determines the second circumstance variable (y) to be "4" by the control of the controlling means 11 (S1017) and completes the second circumstance variable determination process.

When it is determined that the distance between the vehicles is not less than 3 m at the step S1016 (S1016:2), the vehicle communication device 10 determines the second circumstance variable (y) to be "−1" by the control of the controlling means 11 (S1018) and completes the second circumstance variable determination process.

When it is determined that the cruising speed is neither not more than 5 km/h nor not less than 40 km/h at the step S1014 (S1014:3), the vehicle communication device 10 determines the second circumstance variable (y) to be "−1" by the control of the controlling means 11 (S1019) and completes the second circumstance variable determination process.

Thus, based on the circumstance of its own vehicle and the imaging device 20 detected and determined by the above processes, the vehicle communication device 10 detects the vehicle identification information obtained from the determined imaging device 20, determines the notification information from the circumstance of its own vehicle based on the notification information determination table 12*d*, and transmits the notification information based on the vehicle identification information. Next, a description will be made of a specific process for transmitting the notification information as described above.

Figure 21:
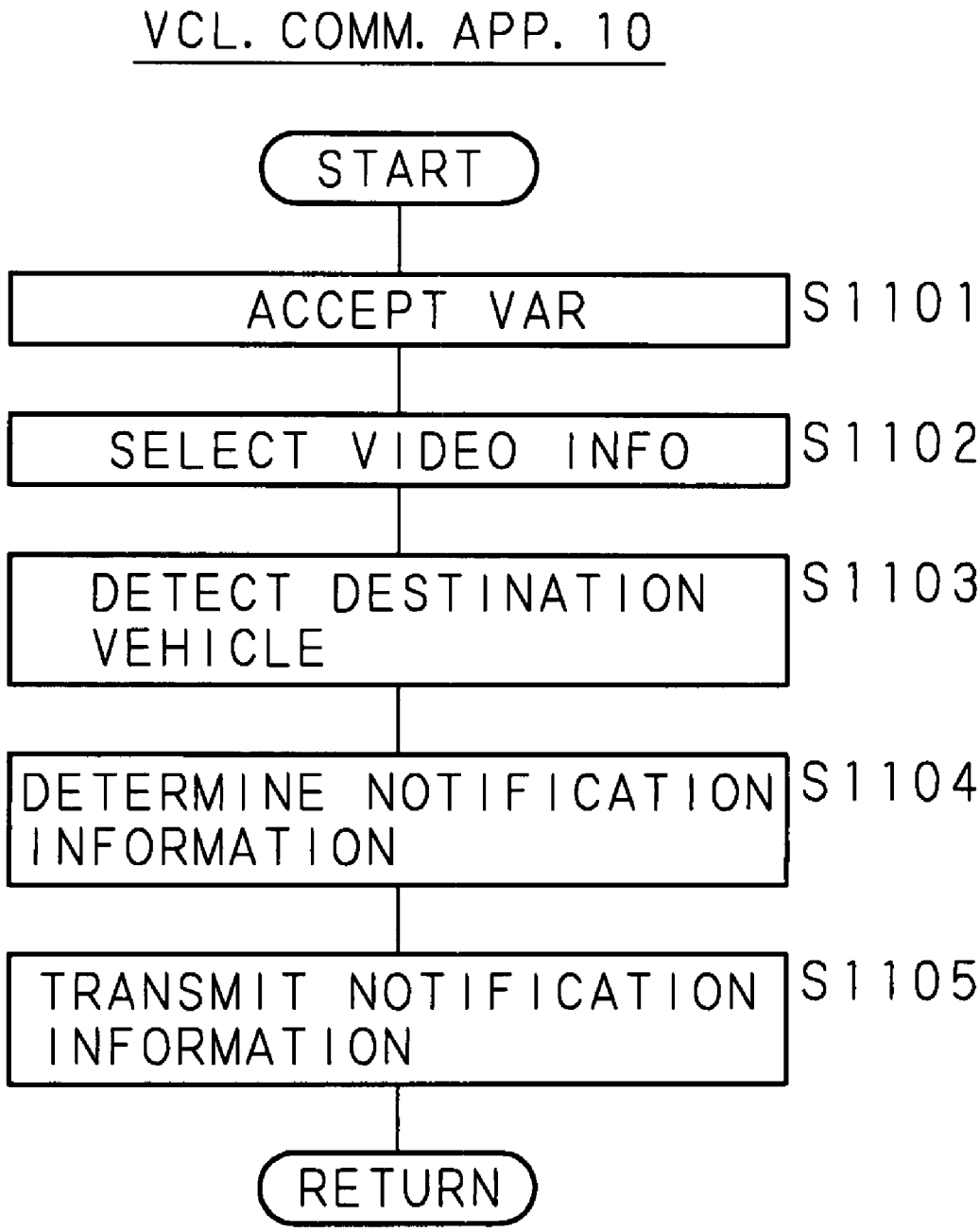
FIG. 21 is a flowchart showing one example of a notification information transmission process of the vehicle communication device according to an embodiment.
Figure 22:
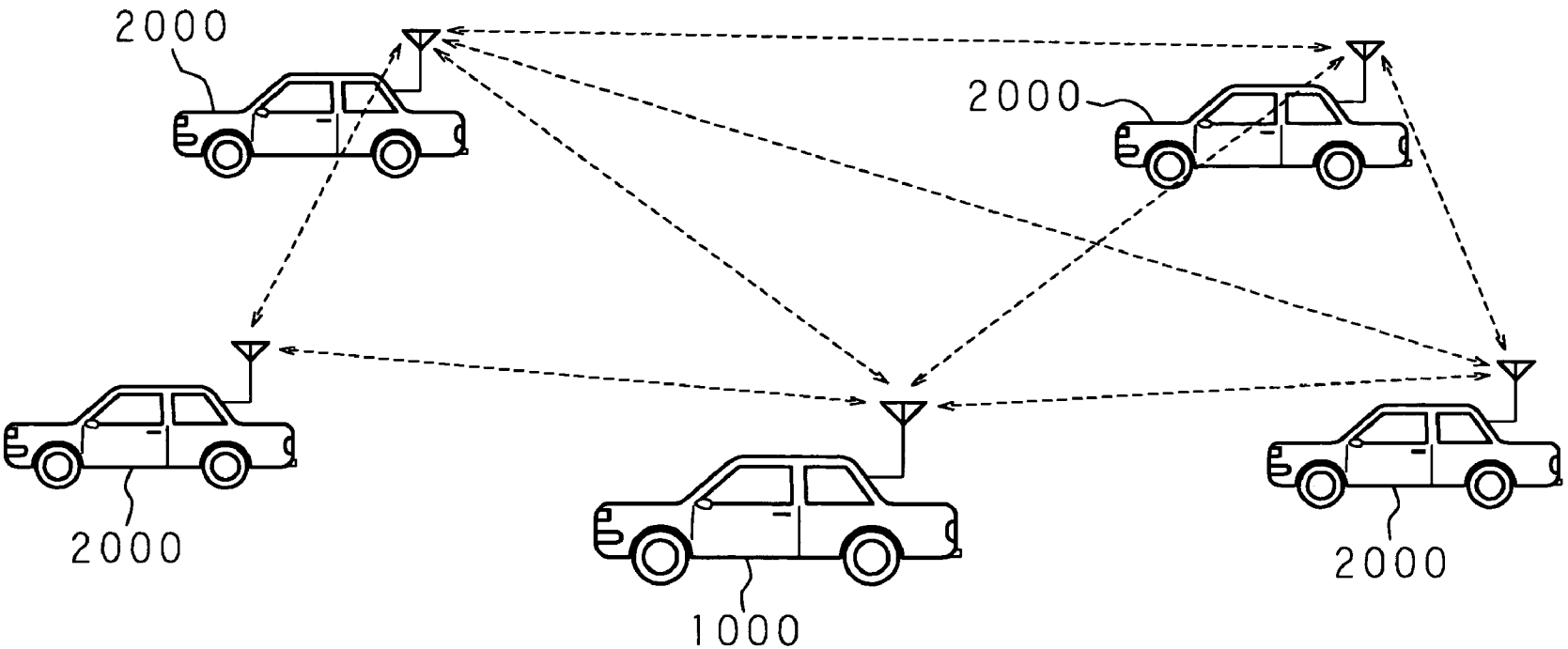
FIG. 22 is a view conceptually showing one example of a communication method among vehicles.

FIG. 21 is a flowchart showing one example of the notification information transmission process of the vehicle communication device 10. The notification information transmission process is started at the step S213 described with reference to FIG. 10 and at the step S311 described with reference to FIG. 10. The vehicle communication device 10 receives the circumstance variable A[x][y] showing the circumstance of the vehicle 1 and the variable showing the imaging device identification information and the effective range by the control of the controlling means 11 that executes the computer program 100 (S1101).

Then, the vehicle communication device 10 selects the video information showing the video taken by the imaging device 20 identified by the received imaging device identification information by the selecting means 16 (S1102), and analyzes the image in the effective range shown by the received variable in the image shown by the selected video information by the vehicle determining means 17, and detects another vehicle to which the notification information is sent (S1103). The step S1103 is a process in which the registered number of the other vehicle is detected (read) from the number plate of the other vehicle in the image in the effective range. Thus, the other vehicle to which the notification information is sent is determined based on the detected registered number. In addition, when the read registered number is set as the vehicle identification information of the data destination, the notification information can be transmitted. Such process in which the registered number of the other car is read as the data destination and the information is transmitted to it is disclosed in Japanese Patent Application Laid-Open No. H09-098125, for example.

Figure 23:
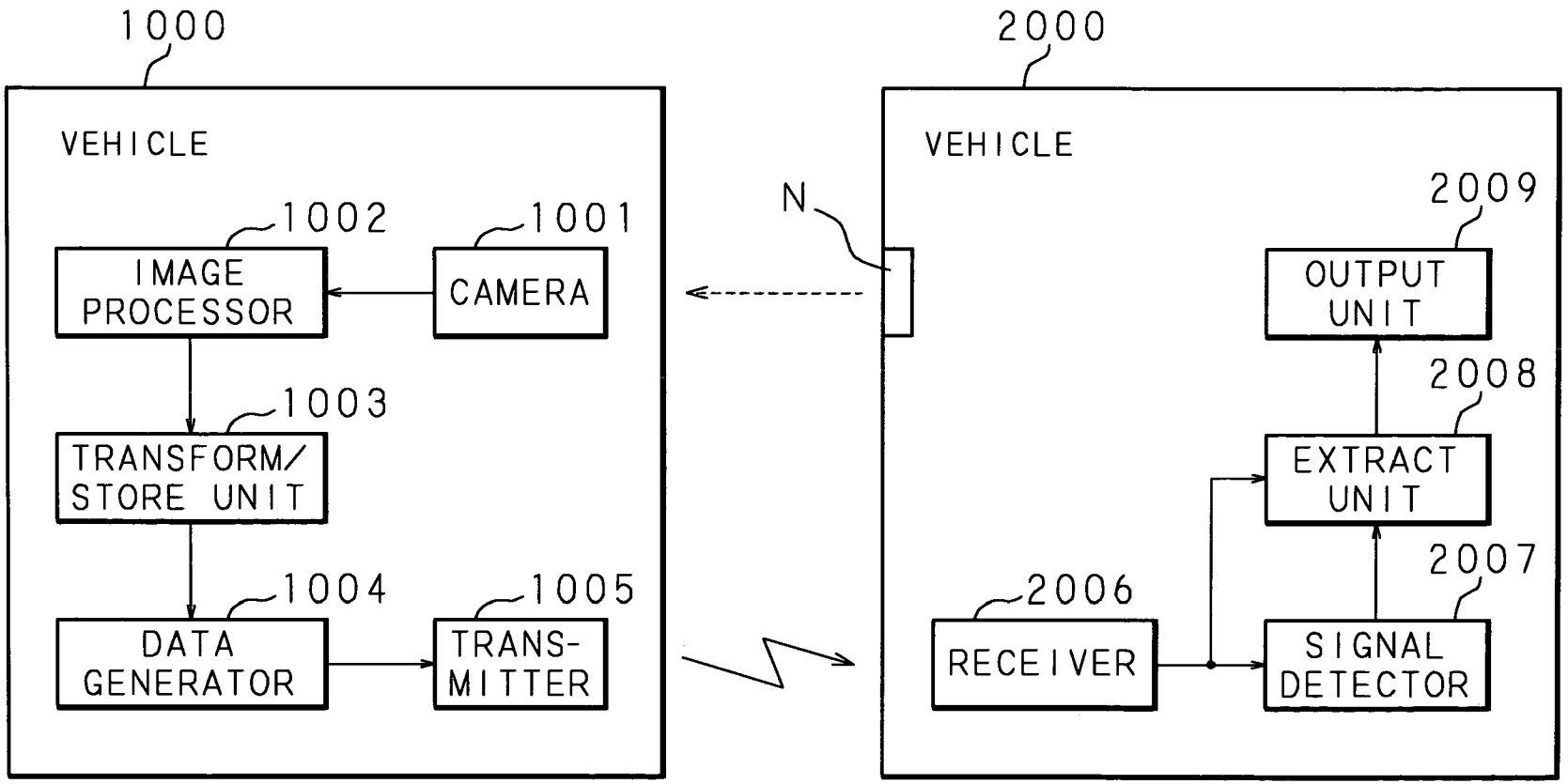
FIG. 23 is a block diagram showing a communication system for transmitting read registered number information of the other vehicle from one vehicle to the other vehicle according to Japanese Patent application Laid-Open No. H09-098125.

According to the Japanese Patent Application Laid-Open No. H09-098125, as shown in FIG. 23, a vehicle 1000 observes a number plate N of another vehicle 2000 by a imaging device 1001 all the time and reads the registered number of the vehicle 2000 by an image signal processing unit 1002. Then, the vehicle 1000 converts the registered number of the vehicle 2000 read by the image signal processing unit 1002 to a signal as an ID for identifying the vehicle B by an ID (identifier) signal conversion/storage unit 1003 and stores it. Thus, the vehicle 1000 specifies the vehicle 2000 from the ID of the vehicle 2000 stored in the ID signal conversion/storage unit 1003.

Thus, when certain information is to be transmitted between the vehicle 1000 and the vehicle 2000, for example, when the information is to be transmitted from the vehicle 1000 to the vehicle 2000 cruising in back of the vehicle 1000 because the vehicle 2000 comes too close to it, the vehicle 1000 generates data containing a signal corresponding to the ID of the vehicle 2000, a synchronization signal and information to be transmitted (for example, abnormal closeness warning message) by a transmission data generator 1004 as transmission data. Then, this transmission data is transmitted from a transmission unit 5. The vehicle 2000 receives the transmission data through a reception unit 2006.

Meanwhile, when the vehicle 2000 obtains an ID signal from an ID signal detection unit 2007 based on the data received by the reception unit 2006, and compares the ID corresponding to this ID signal with an ID previously given to the vehicle 2000. When both match, data (data showing an abnormal closeness warning message, for example) is extracted by a data extraction unit 2008 and the contents of this data is outputted from a data output unit 2009 as sound or an image.

Referring to FIG. 21 again, the vehicle communication device 10 determines the notification information to be outputted, from the received circumstance variable A[x][y] based on the notification information determination table 12*b* by the control of the controlling means 11 (S1104). The process at the step S1104 is performed by referring to the notification information determination table 12*d* in which the circumstance variable A[x][y] and the message to be the notification information are related and recorded. For example, according to the example shown in FIG. 7, when the A[x][y]=1, the previously related message "as the lane will be changed to the right, be careful please" is determined as the notification information. In addition, only the circumstance variable A[x][y] may be transmitted to another vehicle so that the circumstance variable A[x][y] is converted to the message in that vehicle.

Thus, the vehicle communication device 10 transmits the notification information determined at the step S1104 from the communicating means 18 to the other vehicle determined at the step S1103 by the control of the controlling means 11 (S1105). The notification information transmitted at the step S1105 contains not only the message but also vehicle identification information of the other vehicle to which the notification information is sent according to need, and the vehicle identification information, the kind of the vehicle, the present position, the traveling (cruising) speed, the traveling (cruising) direction, the shift position, the state of the brake light, the state of the direction indicator, and the state of the hazard flasher of the vehicle 1 of the transmission source. The kind of the vehicle includes a large-sized vehicle and a standard-sized vehicle. The present position includes latitude, longitude and height derived by the GPS, for example. The traveling direction is the direction derived by the GPS and shown by an angle based on the true north. In this way, the notification information transmission process is executed. When there are several pieces of the imaging device identification information and areas that become the effective areas in the shooting range of the imaging device 20, the similar process is carried out for each imaging device identification information and area.

Then, the other vehicle that received the communication information outputs the sound and video through information outputting means 19 based on the received communication information and the like.

Another vehicle is detected by the imaging device in the above-mentioned embodiments. Alternatively, a method other than an image analysis method may be used such that identification information is previously registered in a plurality of vehicles and the identification information and the positional relation between them are detected by wireless communication. Thus, various kinds of methods can be used.

In addition, as for the information regarding the driving operation, the information regarding the cruising condition, and the information regarding the cruising road, not only the illustrated circumstances in the above embodiment, various circumstances can be applied as triggers.

According to the vehicle communication device and the computer program in the aspects, since the notification information and the other vehicle to which the notification information is to be sent are automatically determined, the operation by the driver is not needed and the safety during driving can be improved.

According to the vehicle communication device and the computer program in the embodiments mentioned above, the plurality of imaging devices such as CCD cameras are arranged around the vehicle as detection devices for detecting other vehicles, the circumstance of its own vehicle is detected from the information regarding the driving operation such as the direction indicator operation and the headlamp operation, the information regarding the cruising condition such as the cruising speed and the distance to the vehicle in back, and the information regarding the road such as the cruising lane position, the road segment, the positional relation with the sidewalk, and the positional relation with another road, the notification information to be sent and the direction to confirm the existence of the other vehicle are determined with reference to the predetermined table based on the detected circumstance, the imaging device for detecting the vehicle in the determined direction, and the notification information is sent to the other vehicle detected by the imaging device.

In this constitution, since the notification information and the direction to recognize the existence of the other vehicle based on the circumstance of its own vehicle are automatically determined, the operation by the driver is not needed when the notification information is determined and the vehicle to which the notification information is sent is determined, so that the attention is prevented from being scattered due to the operation and the dangerous situation can be avoided. As a result, there can be provided a superior effect that the safety at the time of driving can be improved.

As this description may be embodied in several forms without departing from the spirit of essential characteristics thereof, the present embodiments are therefore illustrative and not restrictive, since the scope is defined by the appended claims rather than by description preceding them, and all changes that fall within metes and bounds of the claims, or equivalence of such metes and bounds thereof are therefore intended to be embraced by the claims.

What is claimed is:

1. A vehicle communication device to be mounted on one vehicle provided with a plurality of vehicle detection devices for detecting other vehicles, comprising:

a communication device for transmitting information to the detected other vehicles and receiving information from the other vehicles;

an output device for outputting the received information; and a control unit for performing the operations of:

obtaining a piece of information containing information regarding a driving operation;

detecting a circumstance of the one vehicle corresponding to the obtained piece of the information, based on a table previously relating the circumstances of the one vehicle to the obtained pieces of the information;

determining at least one of the plurality of the vehicle detection devices corresponding to the detected circumstance, based on a table previously relating the respective vehicle detection devices each of which faces in each direction to recognize presence or absence of the other vehicles, to the detected circumstances of the one vehicle;

detecting vehicle identification information of the other vehicle to/from which the information is transmitted/received by the communication device, based on vehicle detection information obtained as a result of detection by the determined at least one of the plurality of the vehicle detection devices; and determining a piece of the notification information to be notified to the other vehicle, the piece of the notification information being in accordance with the detected circumstance, based on a table previously relating the pieces of notification information to be notified to the other vehicle, to the detected circumstances of the one vehicle, wherein the communication device transmits the determined piece of the notification information to the other vehicle, regarding the detected vehicle identification information as a communication identifier of the other destination vehicle.

2. The vehicle communication device according to claim 1, wherein the pieces of information comprising the information regarding the driving operation further comprises information regarding a traveling condition and information regarding a traveling road.

3. The vehicle communication device according to claim 1, wherein the plurality of vehicle detection devices are a plurality of imaging devices arranged to take images around the one vehicle, and the control unit detects a vehicle number on a number plate of the other vehicle as the vehicle identification information, based on the image taken by the determined vehicle detection device, in the operation for detecting the vehicle identification information of the other vehicle.

4. The vehicle communication device according to claim 1, wherein the information regarding the driving operation comprises information regarding at least one of operations of direction indicators and headlamps.

5. The vehicle communication device according to claim 2, wherein the information regarding the traveling condition comprises information regarding at least one of a traveling speed and the distance to a vehicle in back.

6. The vehicle communication device according to claim 2, wherein the information regarding the road comprises information regarding at least a traffic lane position, a road segment and a positional relation to another road.

7. The vehicle communication device according to claim 1, wherein the notification information comprises message data to notify the other vehicle of the circumstance of the one vehicle.

8. The vehicle communication device according to claim 1, wherein the notification information includes at least a piece of data of the vehicle identification information of the other vehicle, a piece of data of the vehicle identification information of the one vehicle, and pieces of data regarding the position, speed, direction indicator state of the other vehicle.

9. A computer-readable memory product which records a computer-executable computer program for causing a computer to generate notification information, the computer being to be mounted on one vehicle provided with a plurality of vehicle detection devices for detecting other vehicles and the notification information being transmitted to the other vehicles, the computer program comprising the steps of:

obtaining a piece of information containing information regarding a driving operation;

detecting a circumstance of the one vehicle corresponding to the obtained piece of the information, based on a table previously relating the circumstances of the one vehicle to the obtained pieces of the information;

determining at least one of the plurality of the vehicle detection device corresponding to the detected circumstance, based on a table previously relating the respective vehicle detection devices each of which faces in each direction to recognize presence or absence of the other vehicles, to the detected circumstances of the one vehicle;

detecting vehicle identification information of the other vehicle to which the notification information is transmitted, based on vehicle detection information obtained as a result of detection by the determined vehicle detection device; and determining a piece of the notification information to be transmitted to the other vehicle, the piece of the notification information being in accordance with the detected circumstance, based on a table previously relating the pieces of the notification information to be transmitted to the other vehicle, to the detected circumstances of the one vehicle.

10. A vehicle communication device to be mounted on one vehicle provided with a plurality of vehicle detection devices for detecting other vehicles, comprising:

a communication part which both transmits information to the detected other vehicles and receives information from the other vehicles;

an output part which outputs the received information;

an information obtaining part which obtains pieces of information containing information regarding a driving operation;

a vehicle circumstance detecting part which detects a circumstance of the one vehicle corresponding to the obtained piece of the information, based on a table previously relating the circumstances of the one vehicle to the obtained pieces of the information;

a vehicle detecting device determining part which determines at least one of the plurality of the vehicle detection devices corresponding to the detected circumstance, based on a table previously relating the respective vehicle detection devices each of which faces in each direction to recognize presence or absence of the other vehicles, to the detected circumstances of the one vehicle;

a vehicle identification information detecting part which detects vehicle identification information of the other vehicle to/from which the information is transmitted/received by the communication device, based on the vehicle detection information obtained in accordance with detection by the determined vehicle detection device; and a notification information determining part which determines a piece of the notification information to be notified to the other vehicle, the piece of the notification information being in accordance with the detected circumstance, based on a table previously relating the pieces of notification information to be notified to the other vehicle, to the detected circumstances of the one vehicle, wherein the communication part transmits the determined piece of the notification information to the other vehicle, regarding the detected vehicle identification information as a communication identifier of the other destination vehicle.

* * * * *